US011788785B2

(12) United States Patent
Kim et al.

(10) Patent No.: US 11,788,785 B2
(45) Date of Patent: Oct. 17, 2023

(54) VACUUM ADIABATIC BODY AND REFRIGERATOR

(71) Applicant: LG ELECTRONICS INC., Seoul (KR)

(72) Inventors: Bongjin Kim, Seoul (KR); Hyeunsik Nam, Seoul (KR); Deokhyun Youn, Seoul (KR); Jaehyun Bae, Seoul (KR); Jangseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/620,097

(22) PCT Filed: Jul. 9, 2020

(86) PCT No.: PCT/KR2020/008973
§ 371 (c)(1),
(2) Date: Dec. 16, 2021

(87) PCT Pub. No.: WO2021/006644
PCT Pub. Date: Jan. 14, 2021

(65) Prior Publication Data

US 2022/0252334 A1 Aug. 11, 2022

(30) Foreign Application Priority Data

Jul. 9, 2019 (KR) ..... 10-2019-0082645

(51) Int. Cl.
*F25D 23/08* (2006.01)
*F25D 23/02* (2006.01)
(Continued)

(52) U.S. Cl.
CPC ..... *F25D 23/087* (2013.01); *F25D 17/08* (2013.01); *F25D 23/021* (2013.01);
(Continued)

(58) Field of Classification Search
CPC ..... F25D 2317/062; F25D 23/085; F25D 23/028; F25D 23/065; F25D 2201/14; F25D 17/08
See application file for complete search history.

(56) References Cited

U.S. PATENT DOCUMENTS 5,442,933 A 8/1995 Unger
9,010,145 B2 4/2015 Lim et al.
(Continued)

FOREIGN PATENT DOCUMENTS

CN 102455108 5/2012
CN 105737492 7/2016
(Continued)

OTHER PUBLICATIONS

International Search Report and Written Opinion dated Oct. 15, 2020 issued in PCT Application No. PCT/KR2020/008973.
(Continued)

*Primary Examiner* — Daniel J Rohrhoff
(74) *Attorney, Agent, or Firm* — KED & ASSOCIATES, LLP

(57) ABSTRACT

Provided is a vacuum adiabatic body. The vacuum adiabatic body includes a mullion configured to divide a space within the refrigerator into a refrigerating compartment and a freezing compartment, an ice maker placed in the freezing compartment, and an ice-making cool air passage passing through the mullion to connect the freezing compartment to the ice maker. Therefore, cool air may be supplied in an adiabatic state to the ice maker disposed in the refrigerating compartment.

20 Claims, 32 Drawing Sheets

(51) Int. Cl.
*F25D 23/06* (2006.01)
*F25D 17/08* (2006.01)

(52) U.S. Cl.
CPC ..... *F25D 23/028* (2013.01); *F25D 23/065* (2013.01); *F25D 23/08* (2013.01); *F25D 23/085* (2013.01); *F25D 2201/14* (2013.01); *F25D 2317/062* (2013.01)

(56) References Cited

U.S. PATENT DOCUMENTS

| | | | | |
|---|---|---|---|---|
| 10,107,542 | B2 * | 10/2018 | Boarman | F25D 11/006 |
| 10,473,378 | B2 * | 11/2019 | Lee | F25D 17/06 |
| 10,641,537 | B2 * | 5/2020 | Mitchell | F25C 1/24 |
| 10,663,207 | B2 * | 5/2020 | Jeong | F25D 17/065 |
| 2004/0226956 | A1 | 11/2004 | Brooks | |
| 2005/0160756 | A1 * | 7/2005 | Lee | F25D 17/065 62/340 |
| 2008/0034779 | A1 | 2/2008 | Lee et al. | |
| 2010/0251744 | A1 * | 10/2010 | Yun | F25D 23/04 62/340 |
| 2010/0257877 | A1 * | 10/2010 | Yun | F25D 17/065 62/340 |
| 2011/0146331 | A1 | 6/2011 | Moon et al. | |
| 2011/0146335 | A1 * | 6/2011 | Jung | F25D 23/04 62/441 |
| 2012/0096872 | A1 | 4/2012 | Cheong et al. | |
| 2015/0030800 | A1 | 1/2015 | Jung et al. | |
| 2015/0192344 | A1 * | 7/2015 | Lim | F25B 5/02 62/441 |
| 2016/0265836 | A1 | 9/2016 | Hong et al. | |
| 2017/0248348 | A1 * | 8/2017 | Kim | F25B 5/02 |
| 2018/0224184 | A1 * | 8/2018 | Mitchell | F25D 23/067 |
| 2018/0224198 | A1 | 8/2018 | Jung et al. | |
| 2018/0238610 | A1 | 8/2018 | Jung et al. | |
| 2019/0024962 | A1 * | 1/2019 | Lee | F25D 23/025 |
| 2019/0063817 | A1 * | 2/2019 | Kyriacou | F25B 21/02 |
| 2020/0224957 | A1 * | 7/2020 | Gomes | F25D 23/04 |
| 2021/0148627 | A1 * | 5/2021 | Jeong | F25C 5/22 |
| 2023/0011875 | A1 * | 1/2023 | Park | F25D 17/065 |

FOREIGN PATENT DOCUMENTS

| | | |
|---|---|---|
| JP | 2006-170507 | 6/2006 |
| KR | 1999-0021424 | 6/1999 |
| KR | 10-0343719 | 7/2002 |
| KR | 10-2006-0041437 | 5/2006 |
| KR | 10-2008-0014562 | 2/2008 |
| KR | 10-2010-0129671 | 12/2010 |
| KR | 10-1332018 | 11/2013 |
| KR | 10-2015-0012712 | 2/2015 |
| KR | 10-2017-0016187 | 2/2017 |
| KR | 10-2017-0016243 | 2/2017 |
| WO | WO 2019/117600 | 6/2019 |
| WO | WO-2019/117601 | 6/2019 |

OTHER PUBLICATIONS

Chinese Office Action dated Apr. 19, 2023 issued in Application No. 202080050393.0.

Extended European Search Report dated Jun. 12, 2023 issued in Application No. 20837031.2.

* cited by examiner

[Fig. 1]
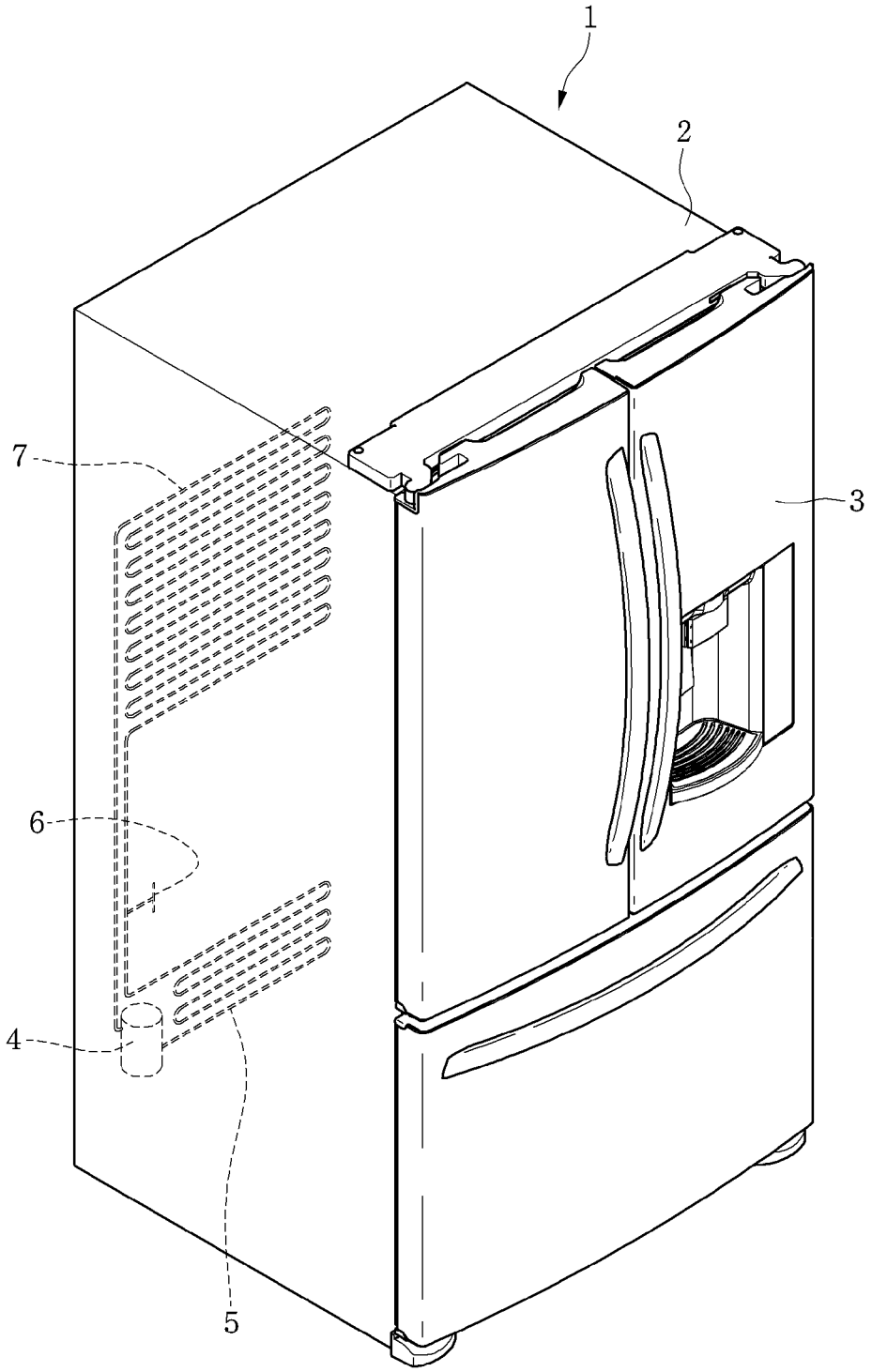

[Fig. 2]
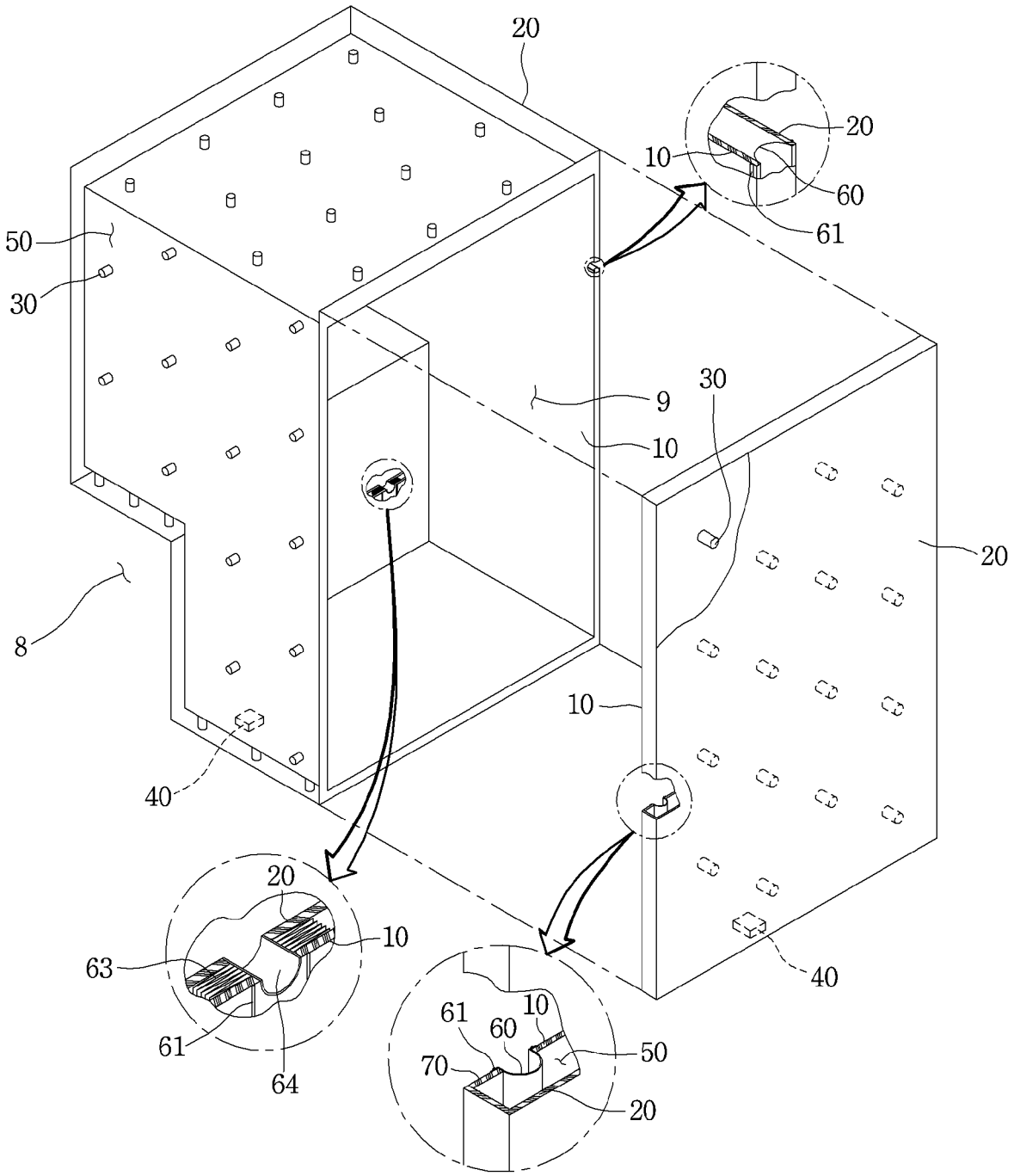

[Fig. 3]
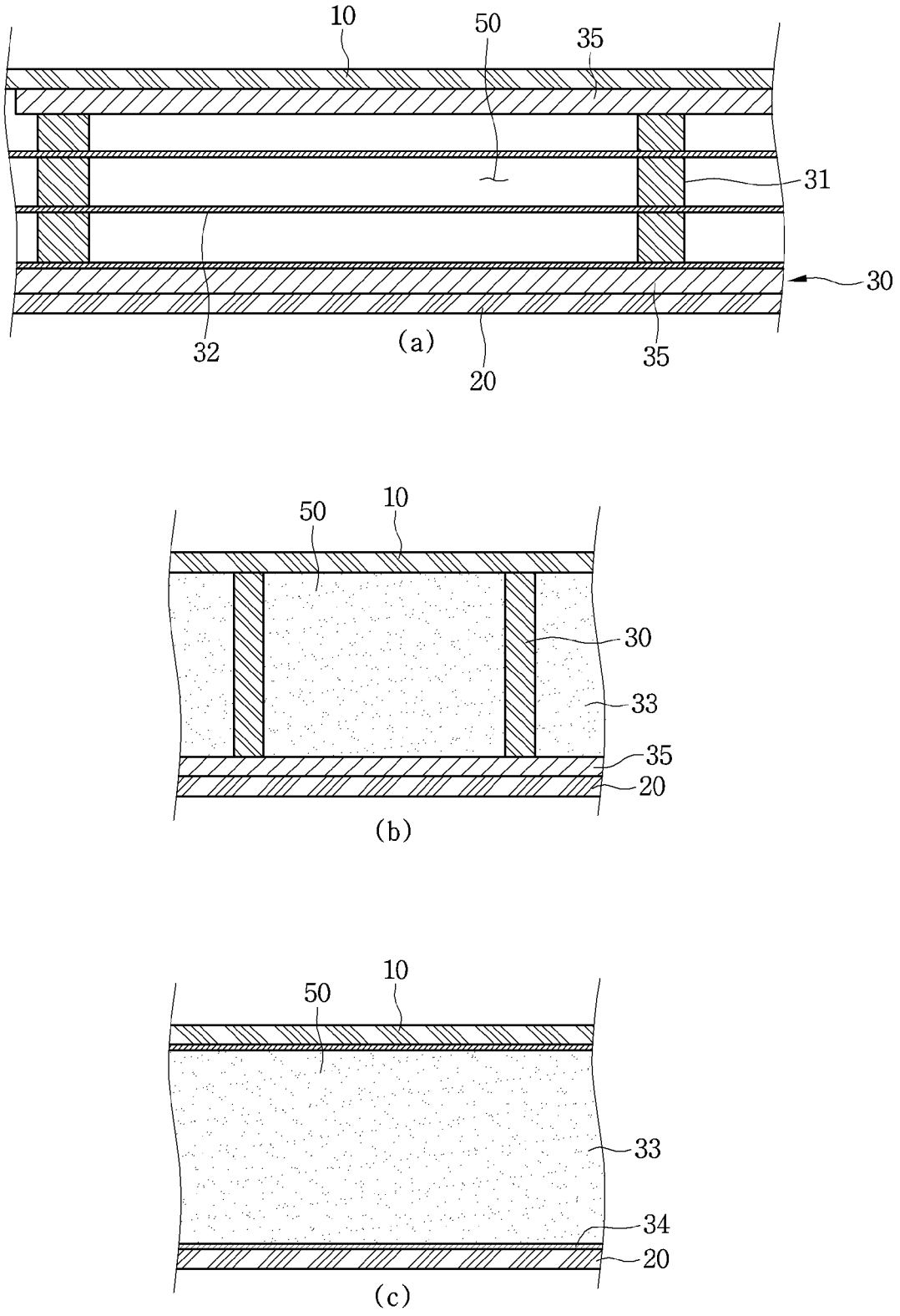

[Fig. 4]
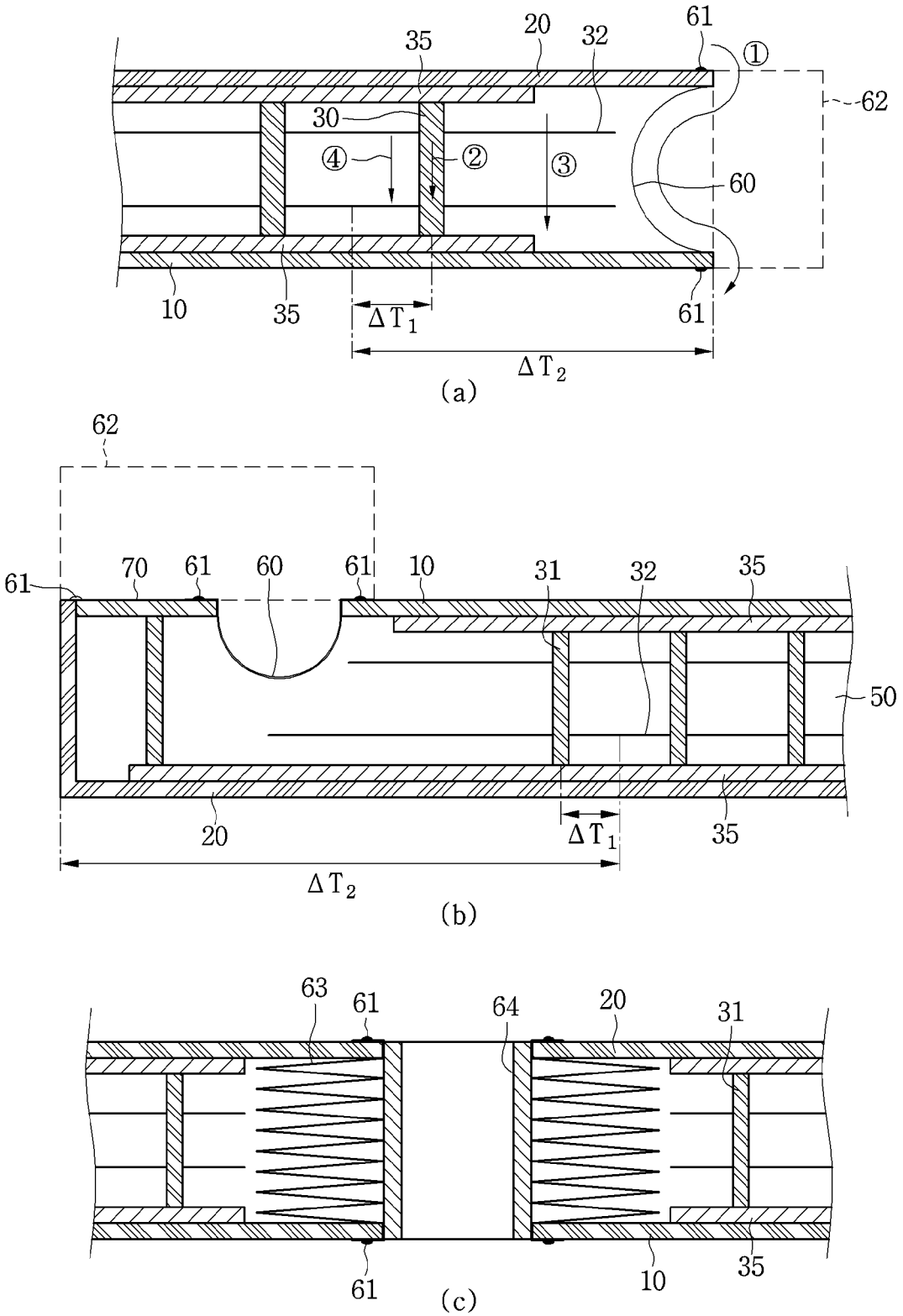

[Fig. 5]
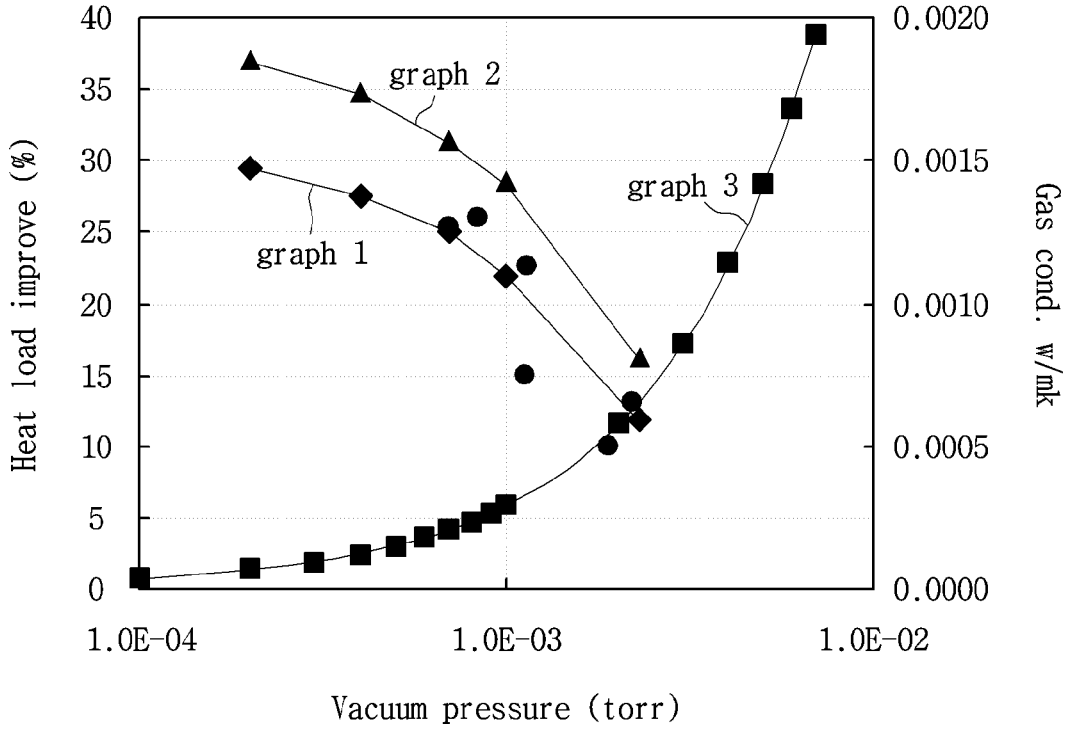
[Fig. 6]
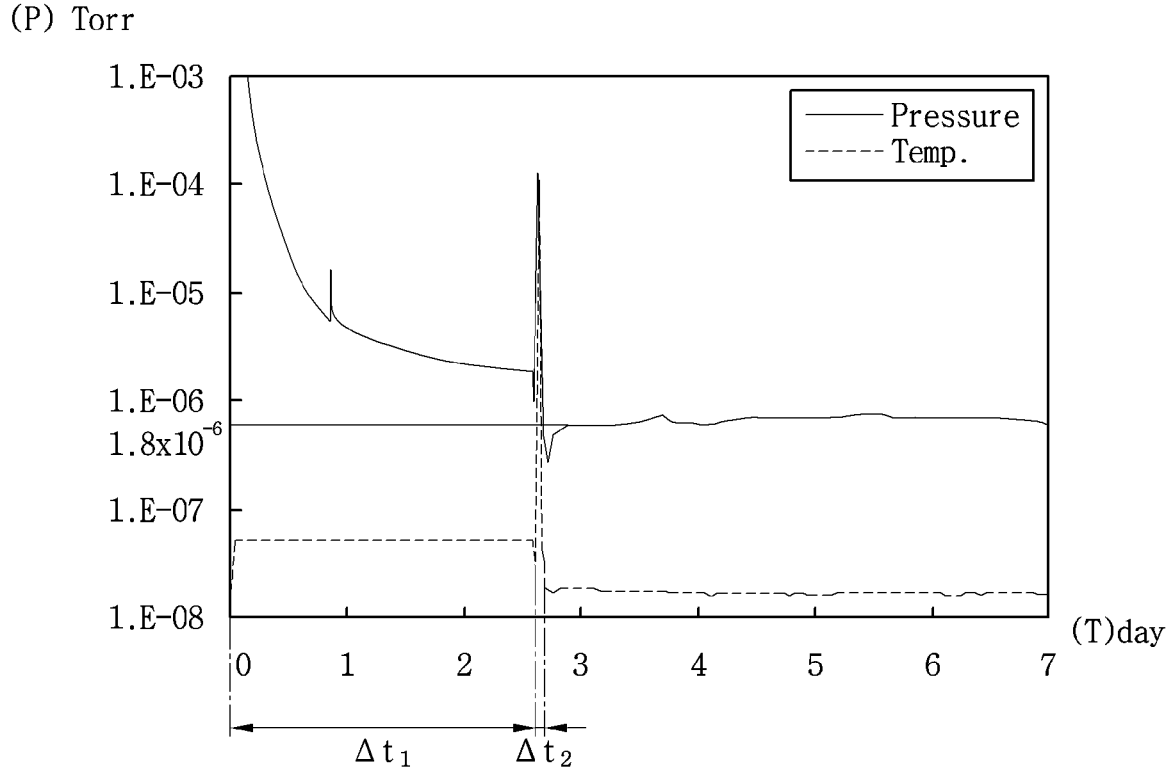

[Fig. 7]
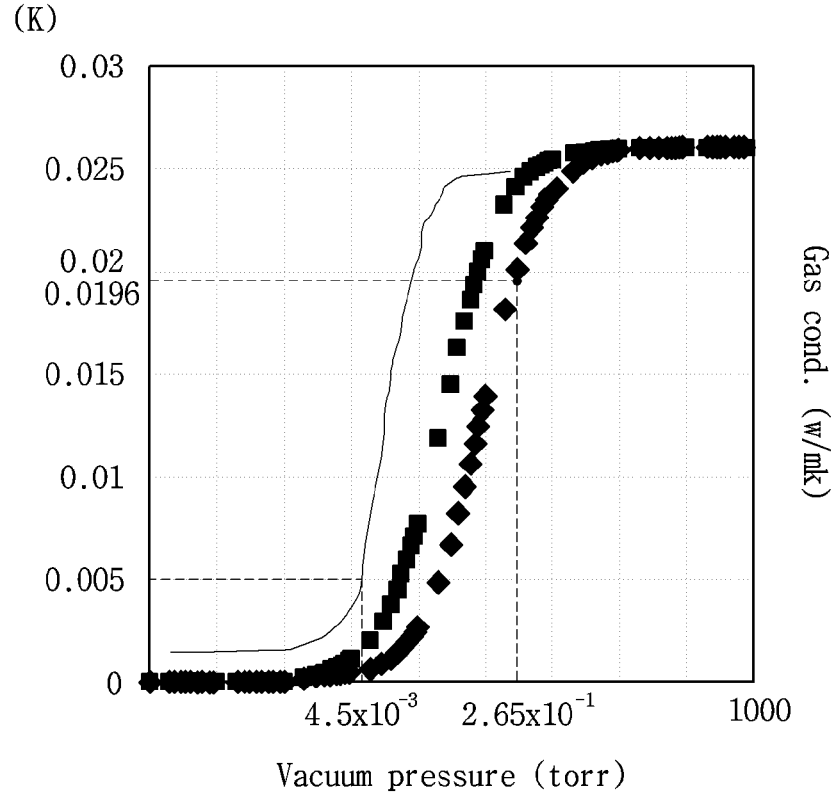

[Fig. 8]
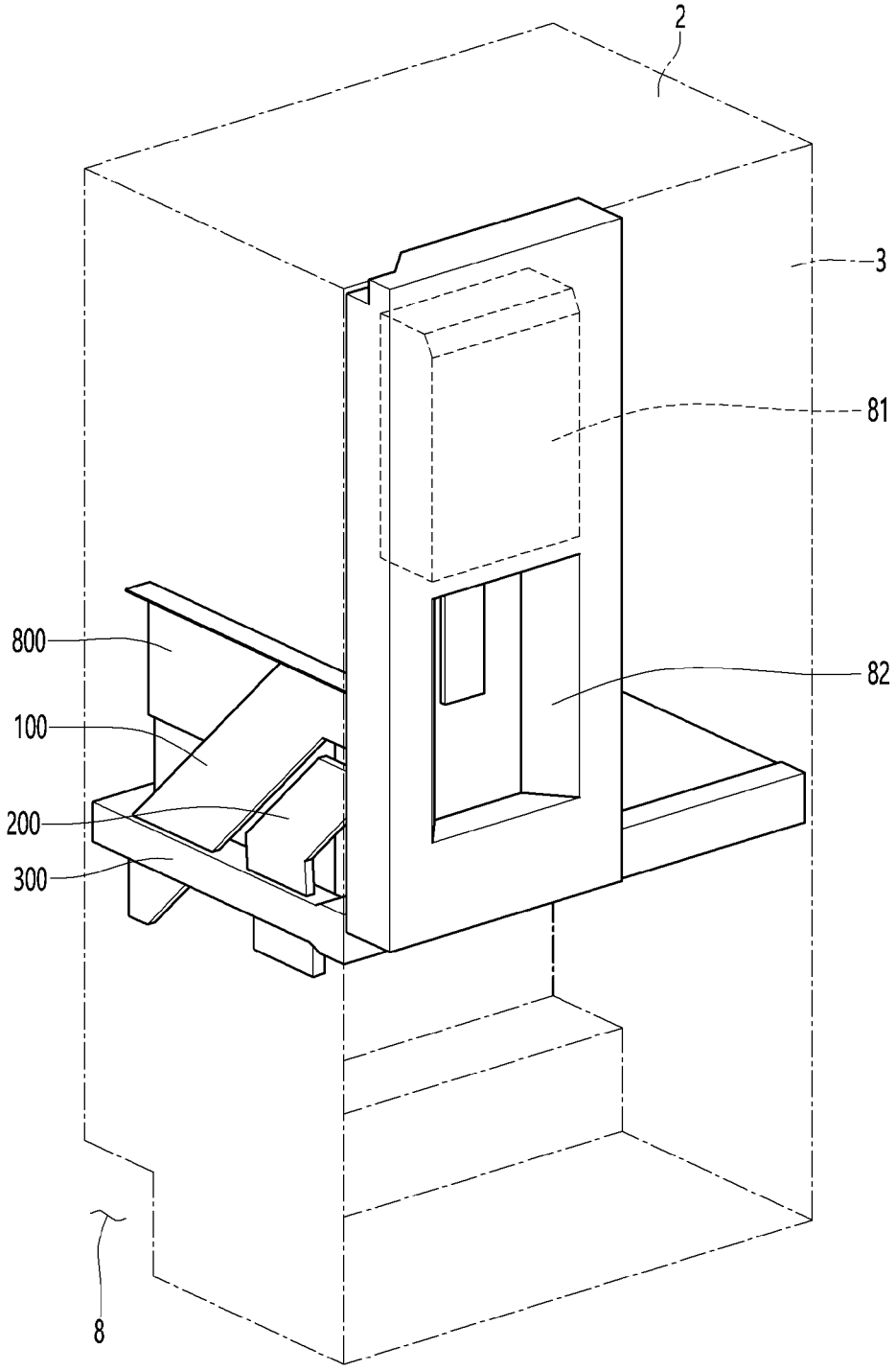

[Fig. 9]
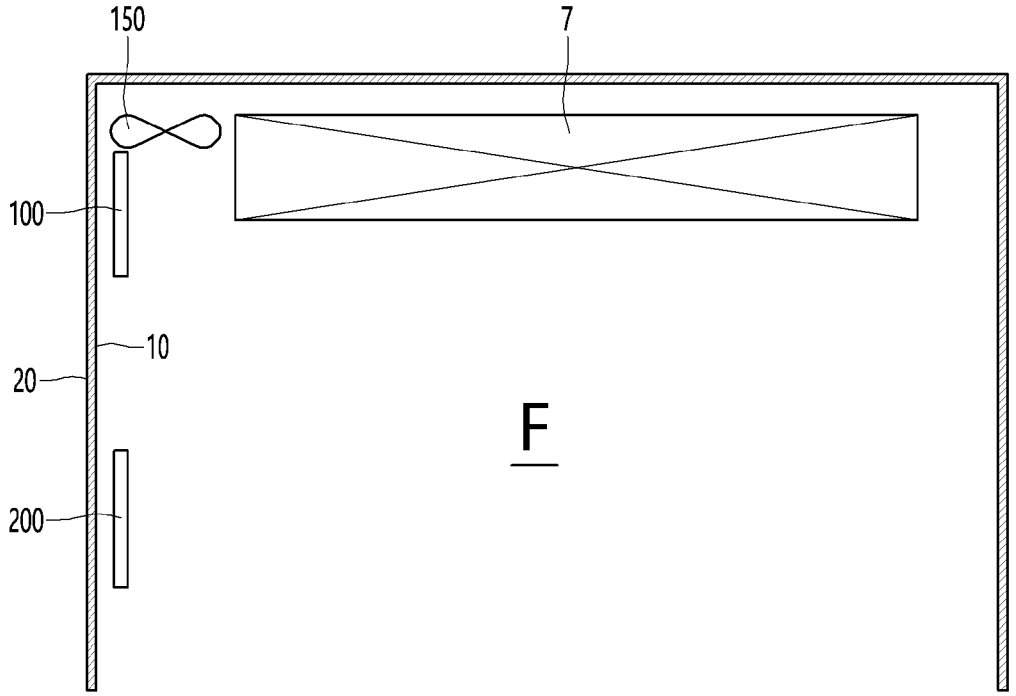
[Fig. 10]
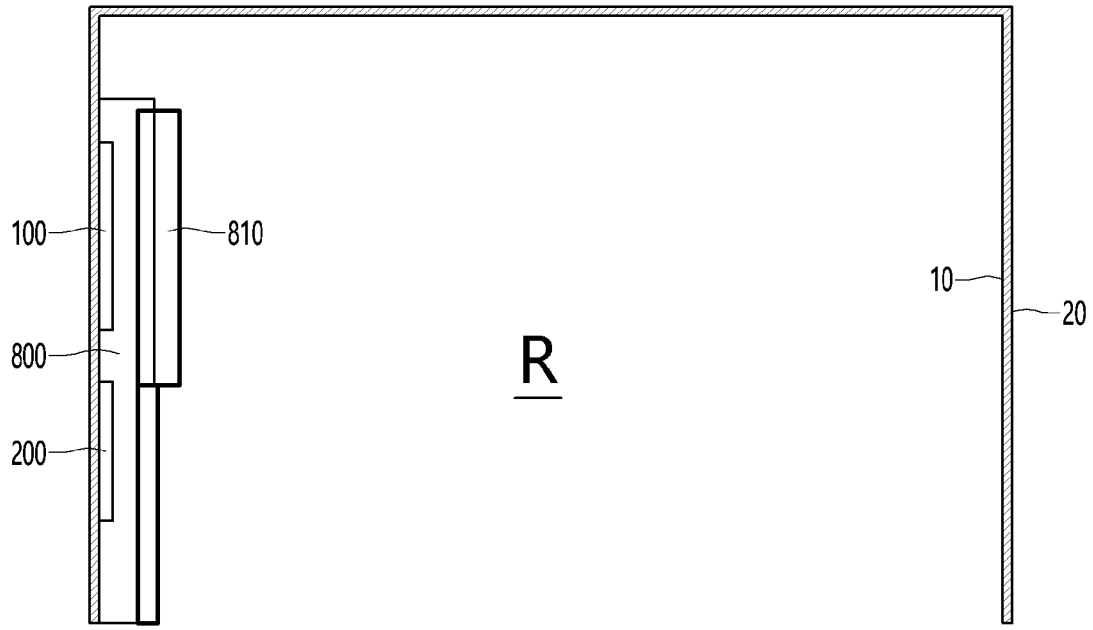

[Fig. 11]
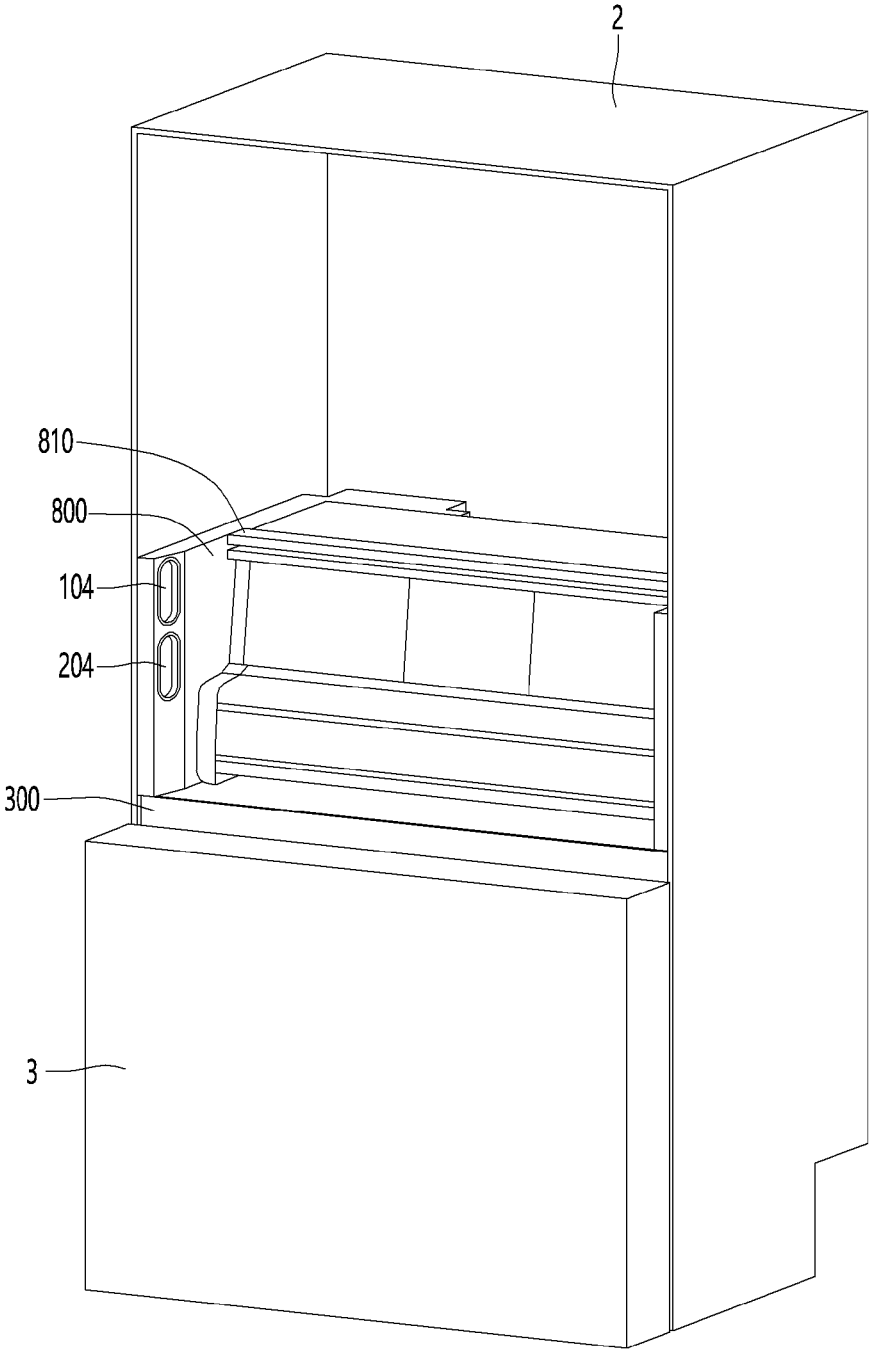

[Fig. 12]
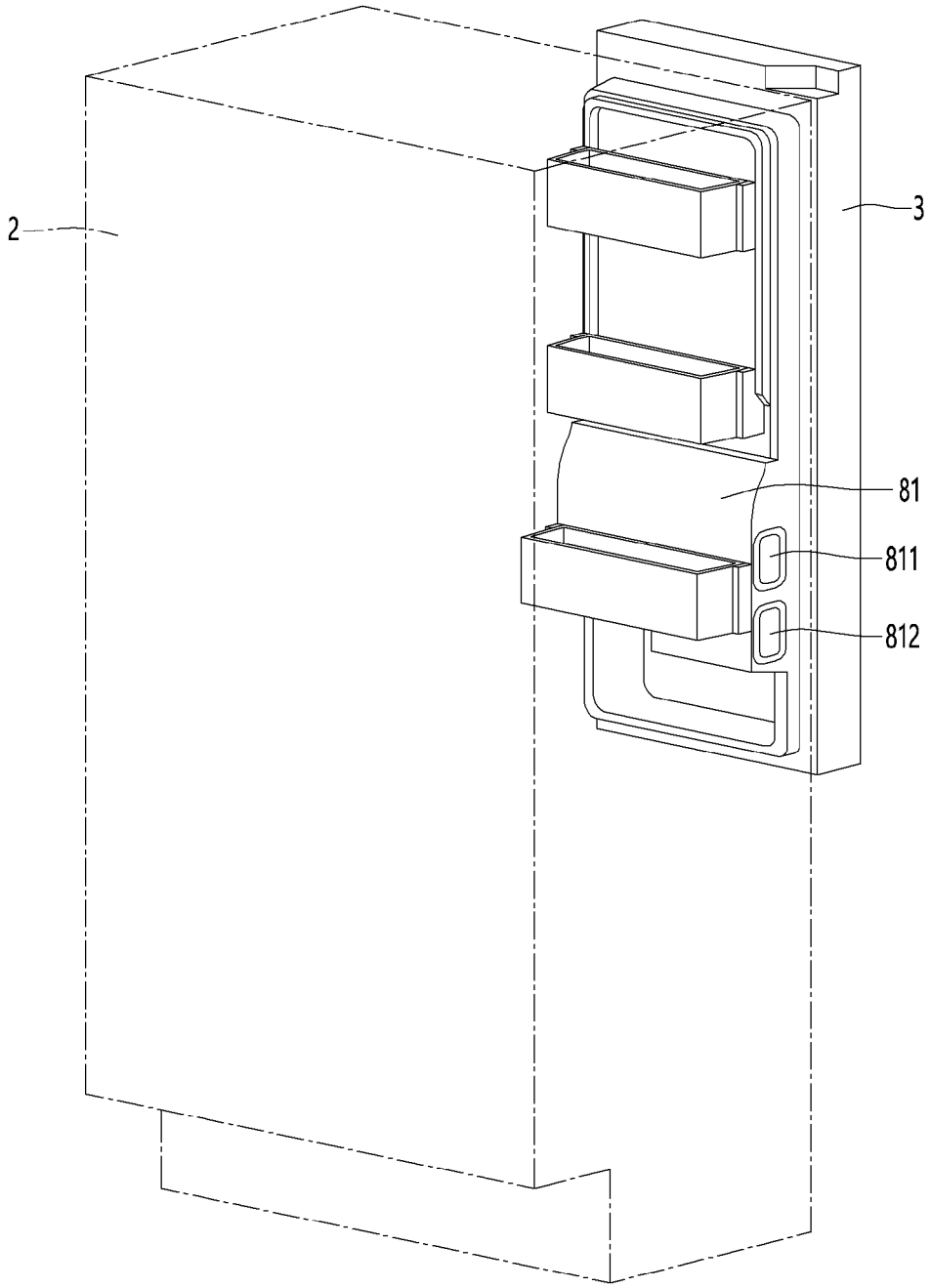

[Fig. 13]
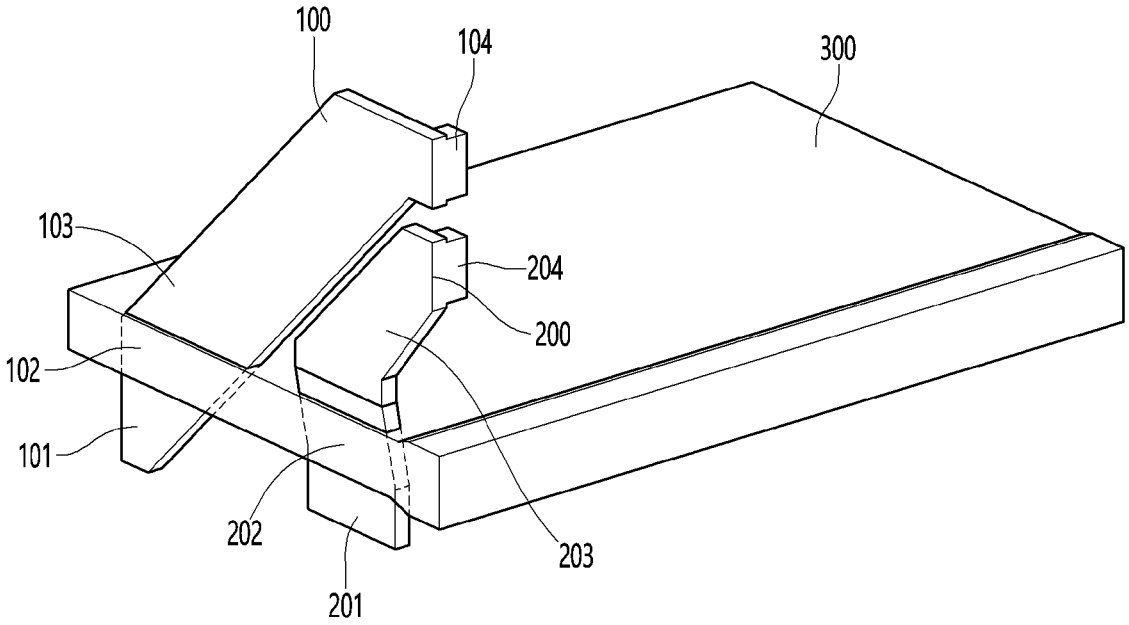

[Fig. 14]
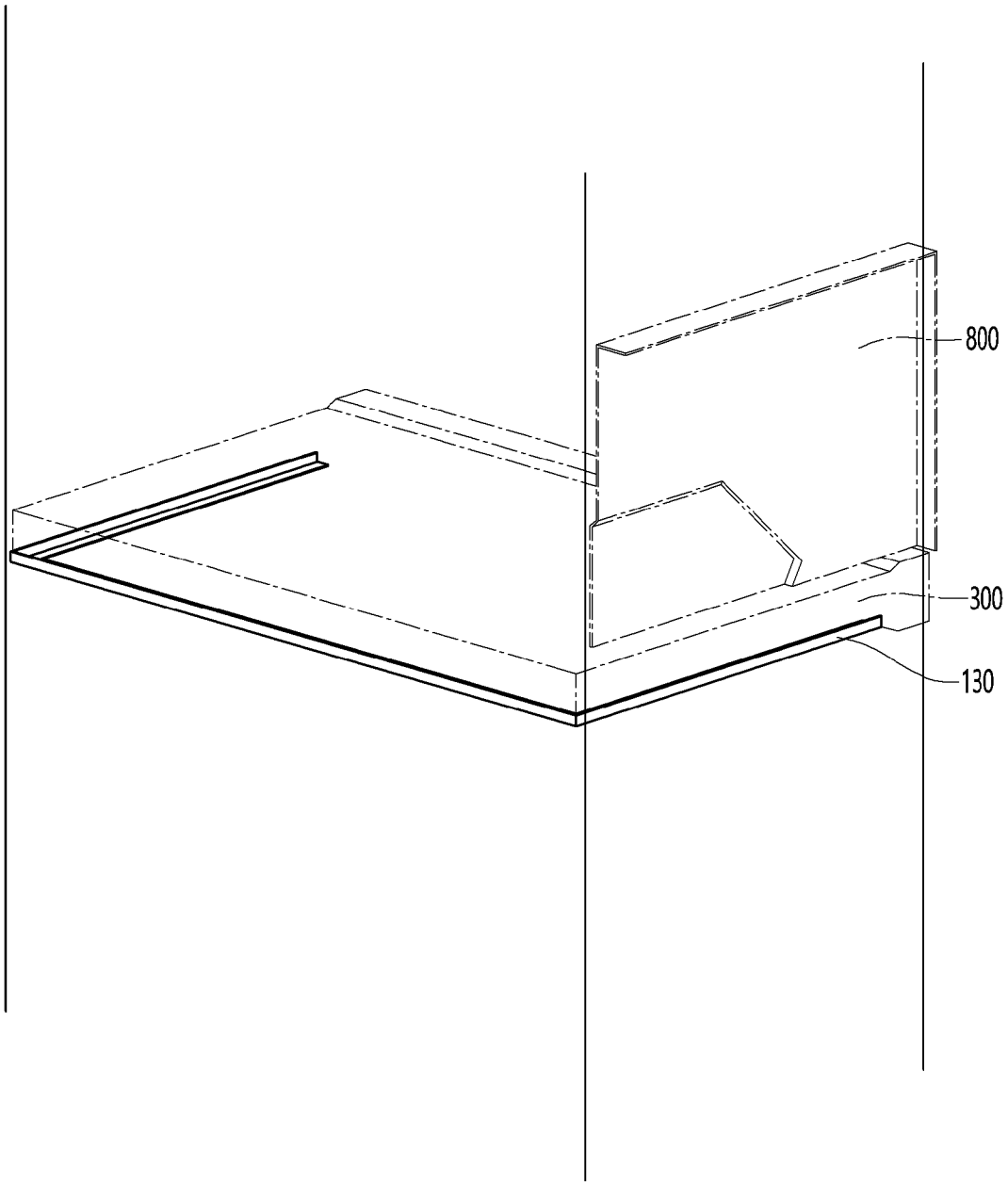

[Fig. 15]
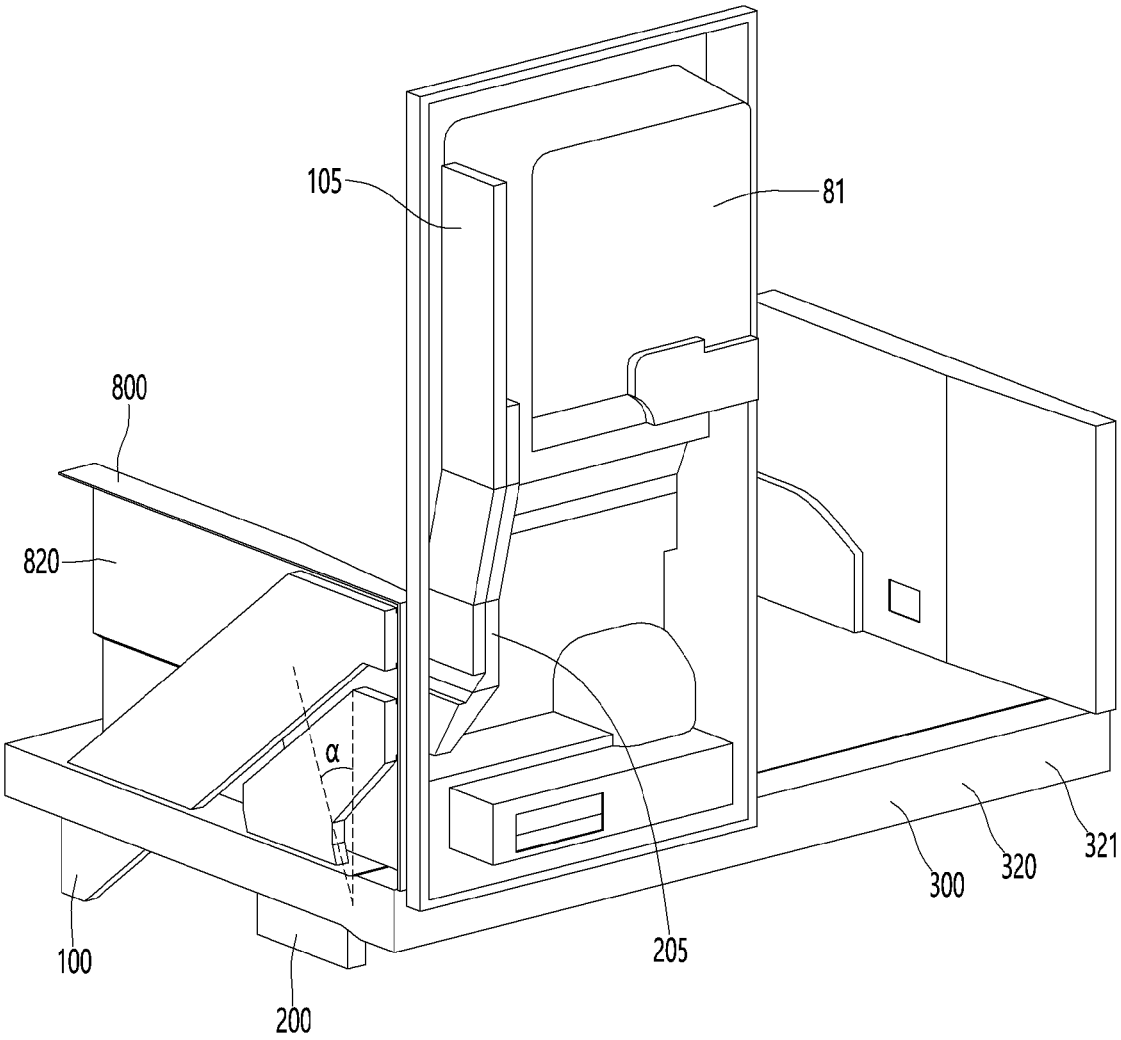

[Fig. 16]
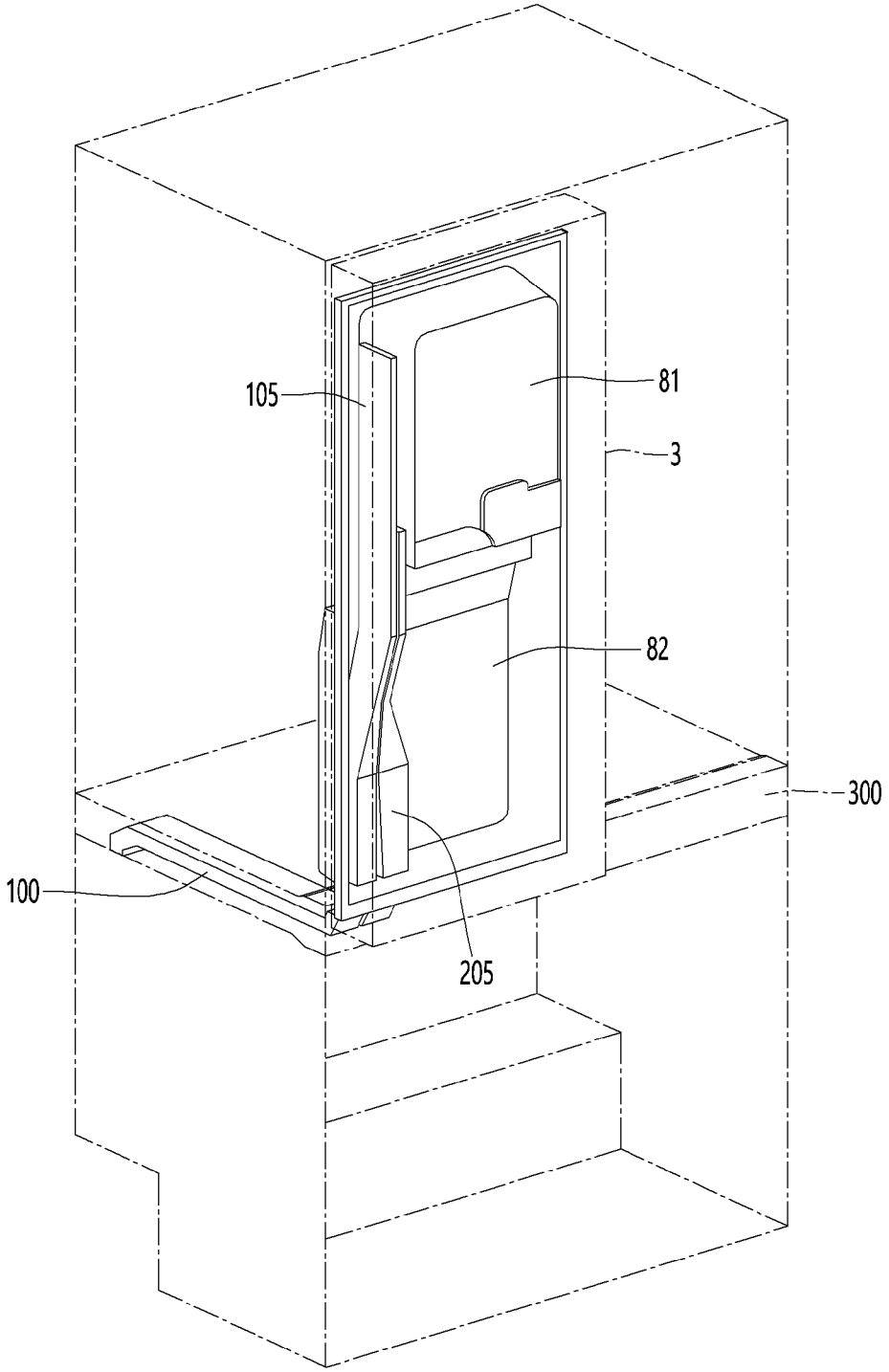

[Fig. 17]
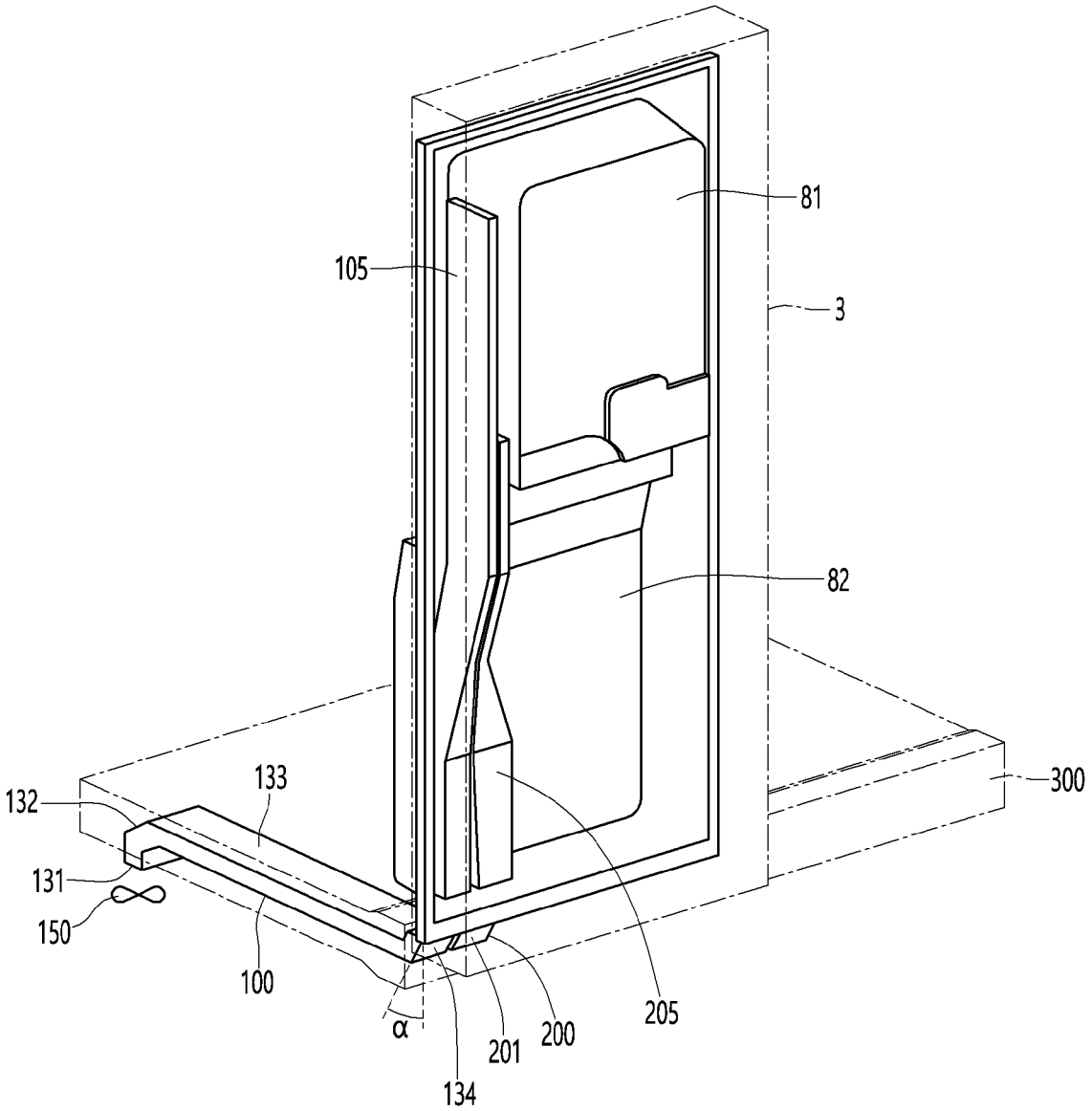

[Fig. 18]
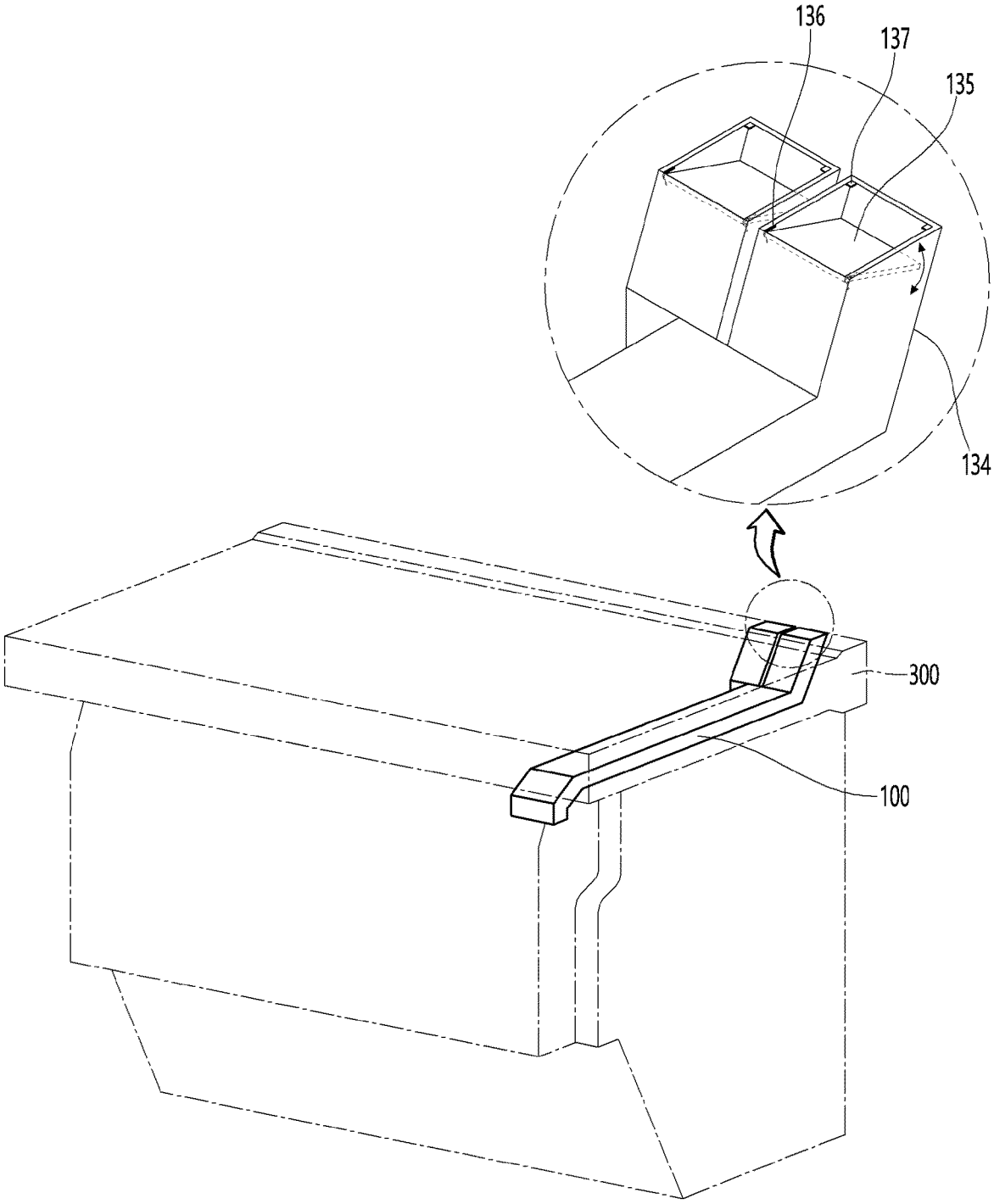

[Fig. 19]
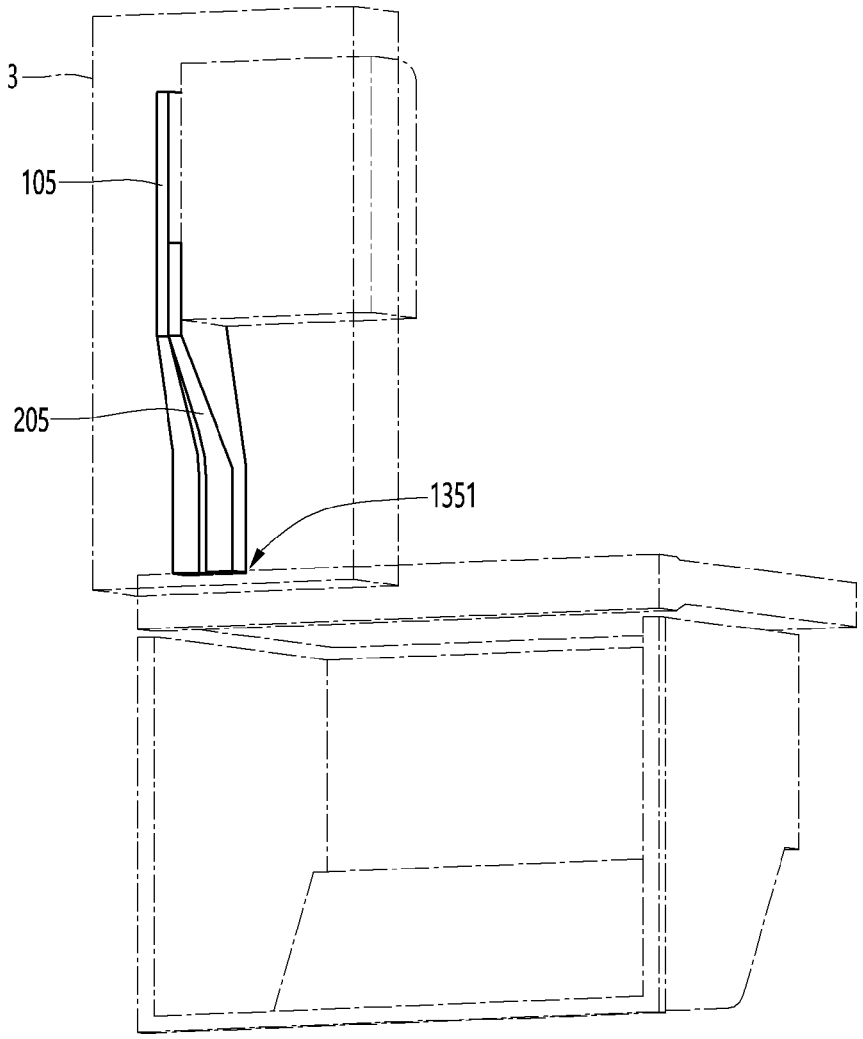

[Fig. 20]
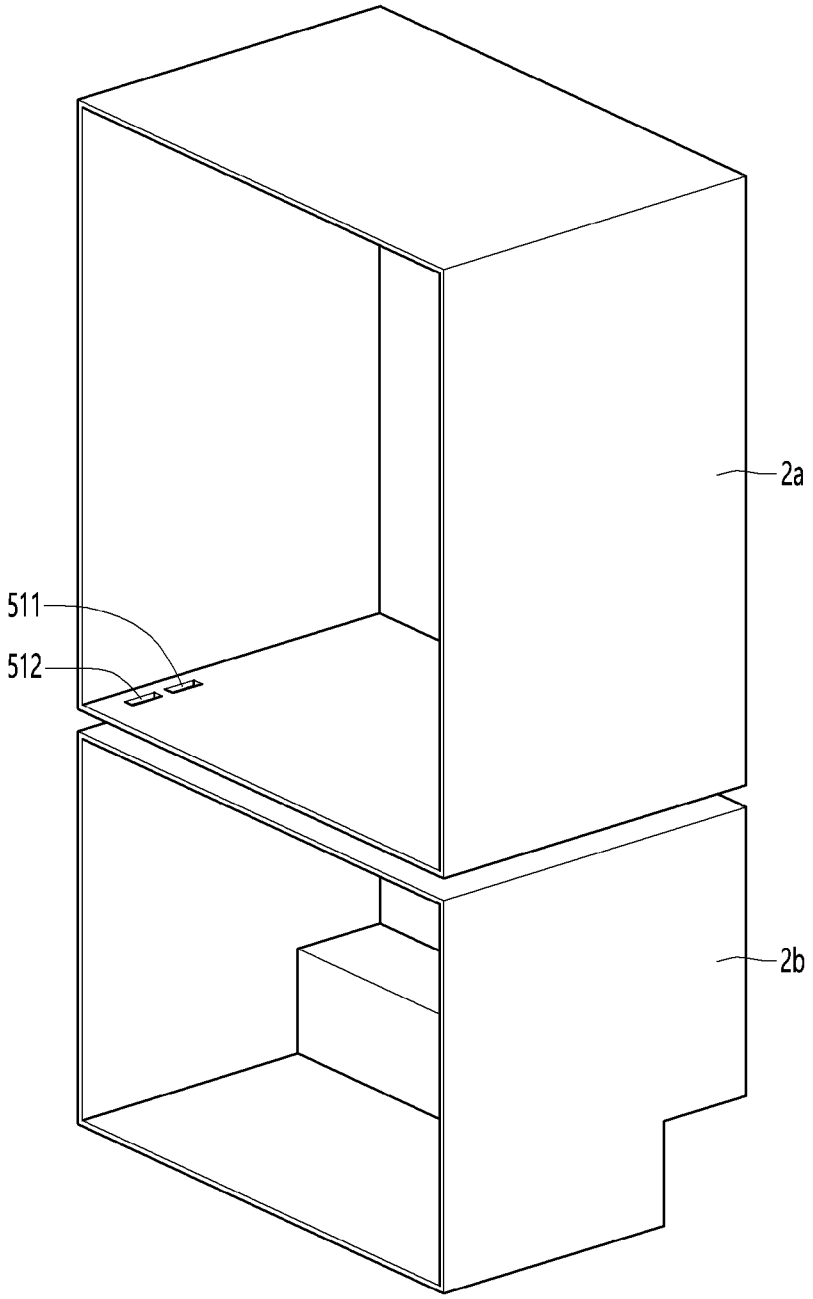

[Fig. 21]
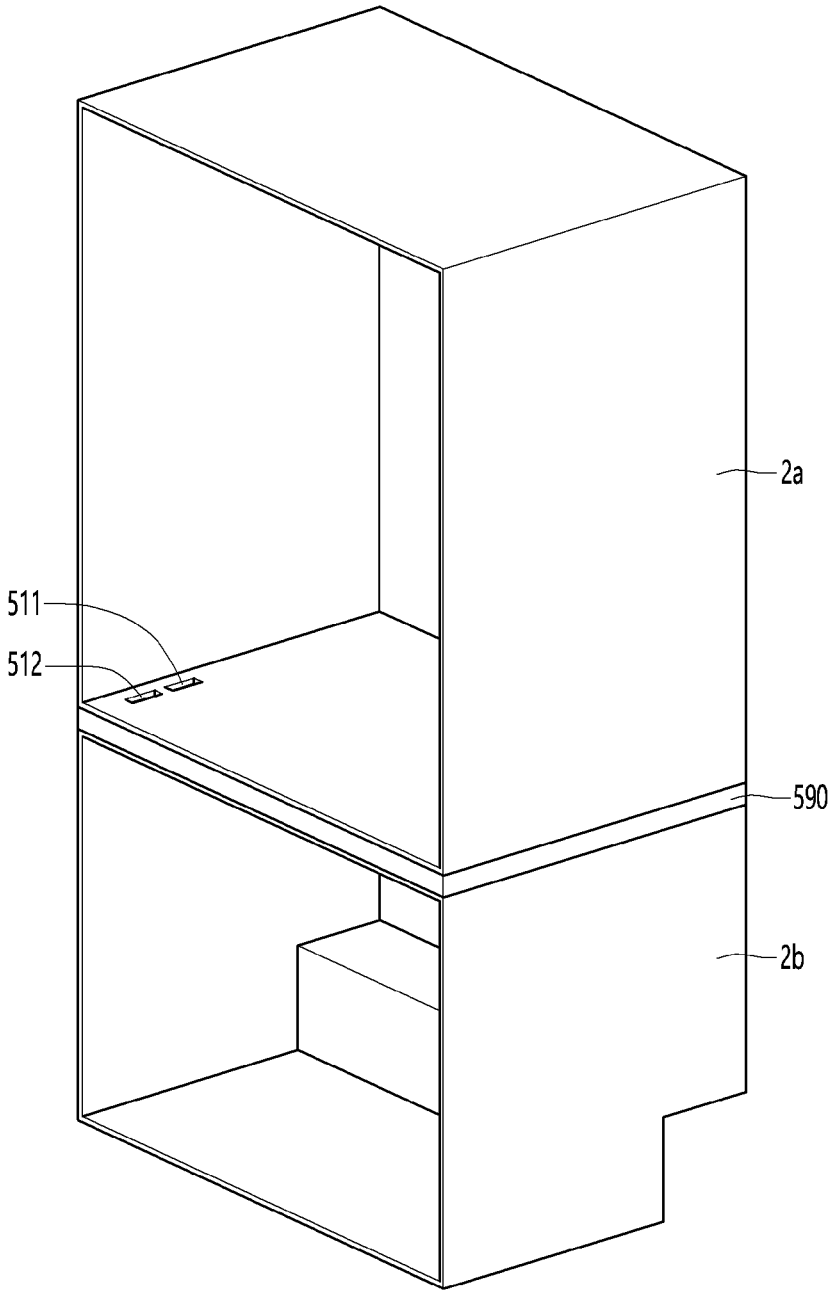

[Fig. 22]
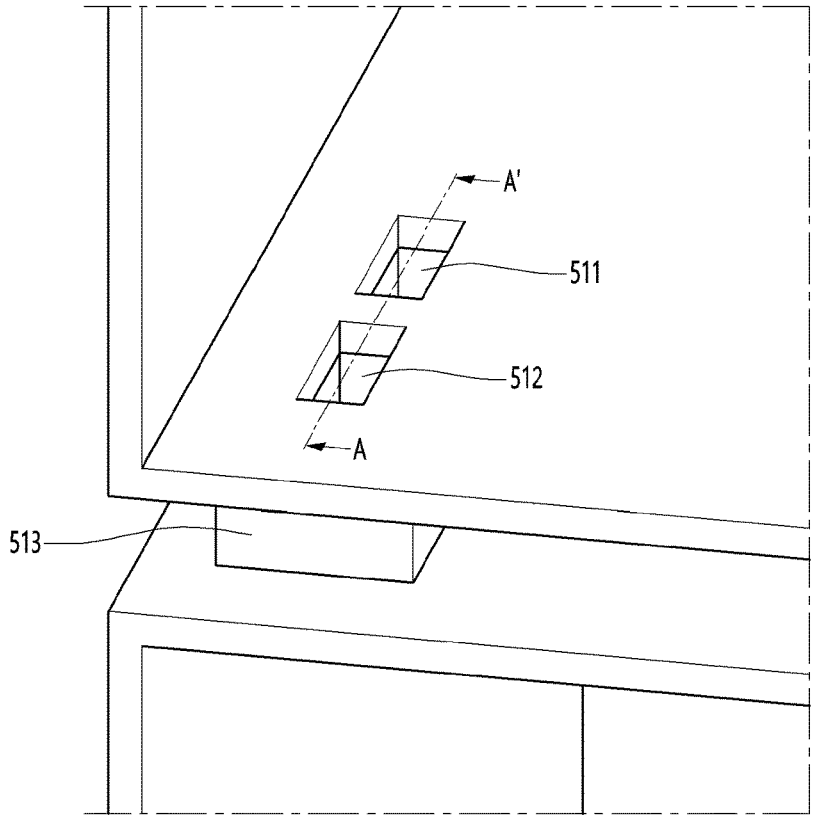
[Fig. 23]
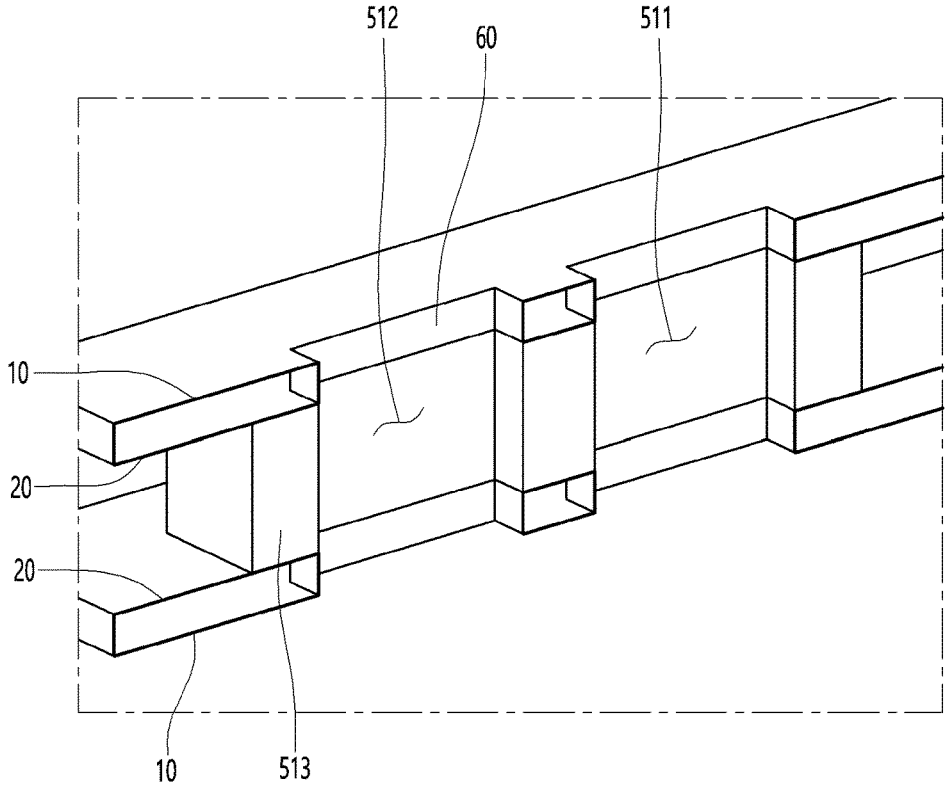

[Fig. 24]
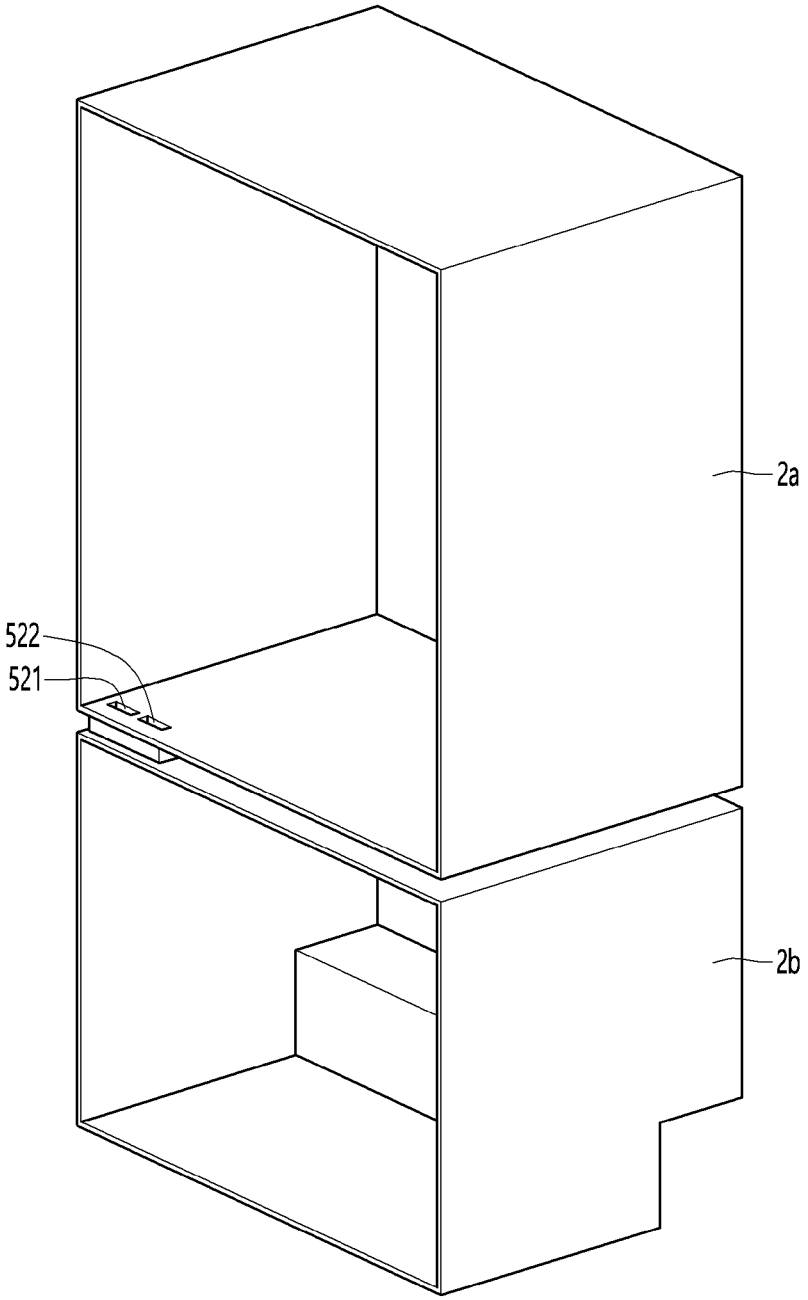

[Fig. 25]
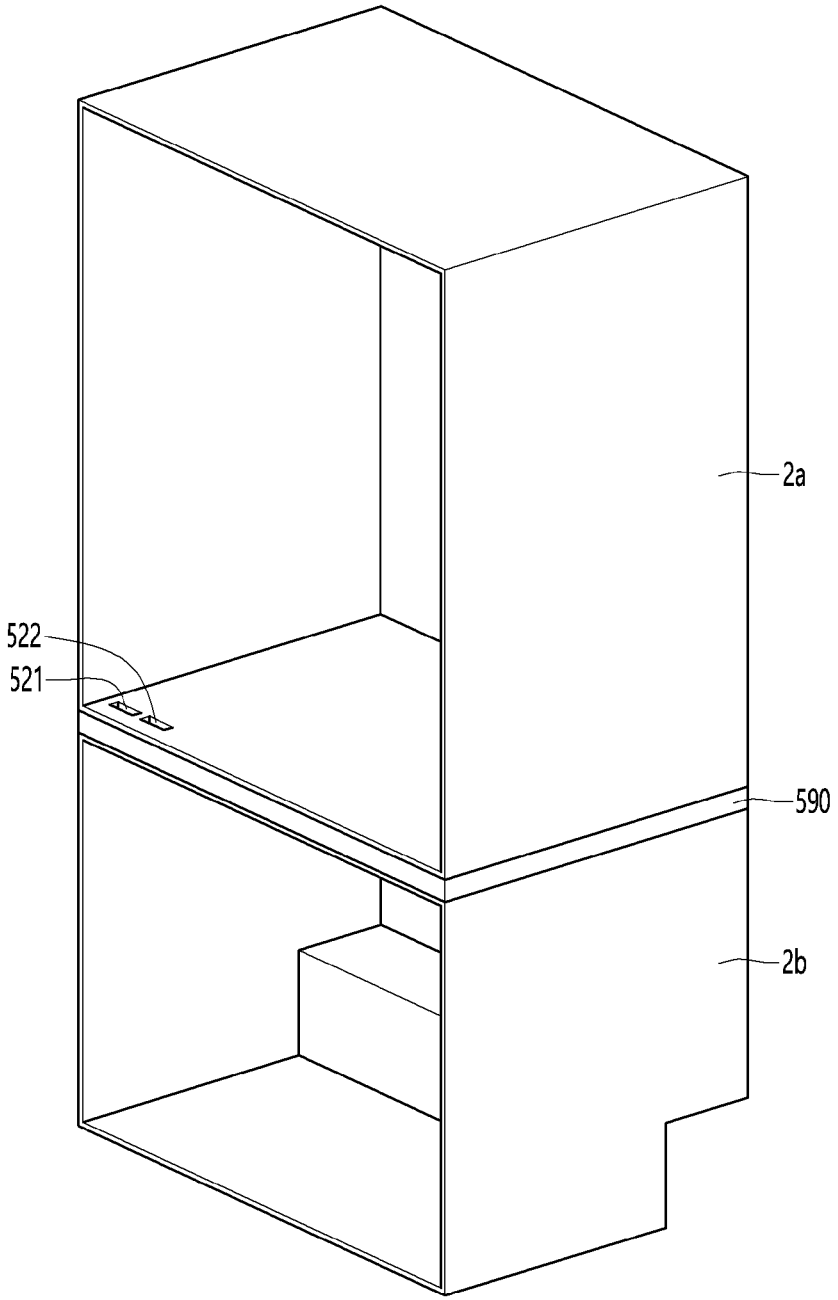

[Fig. 26]
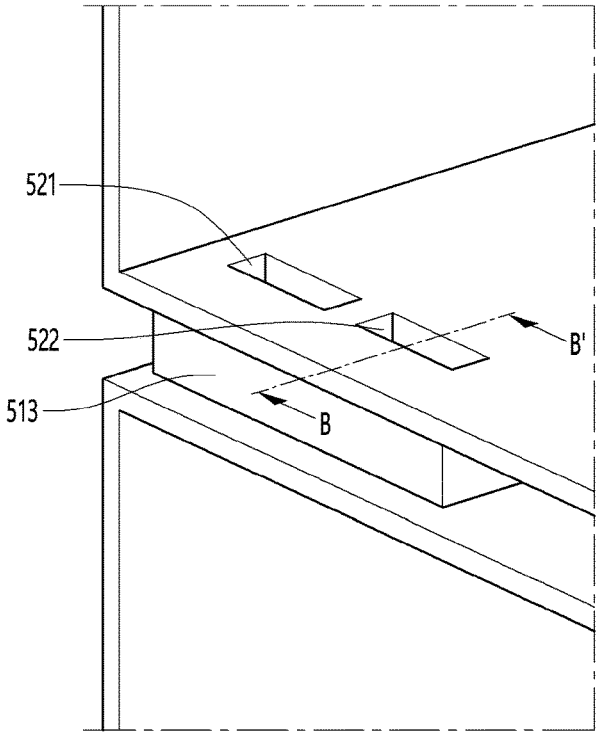
[Fig. 27]
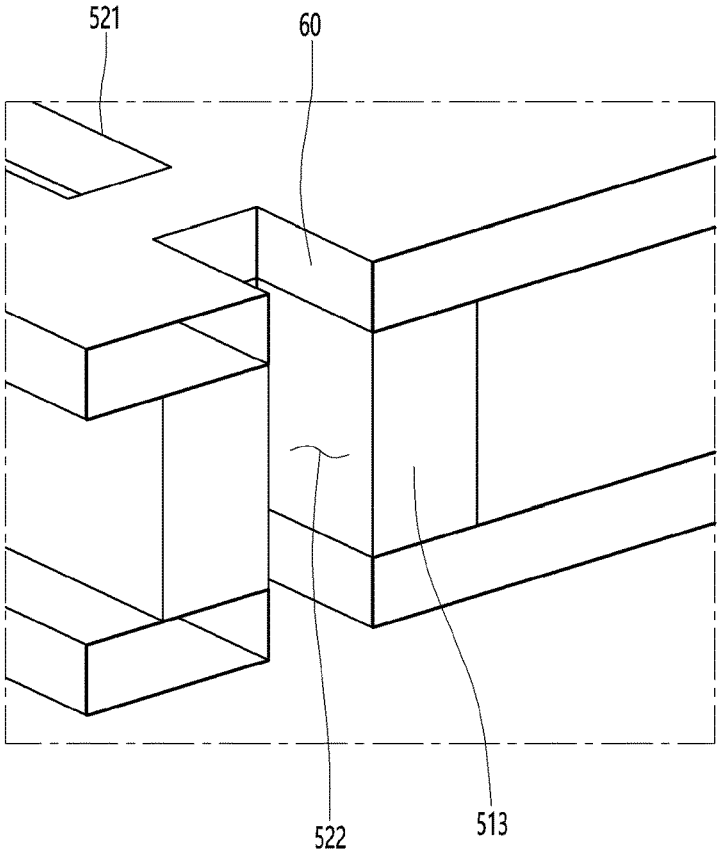

[Fig. 28]
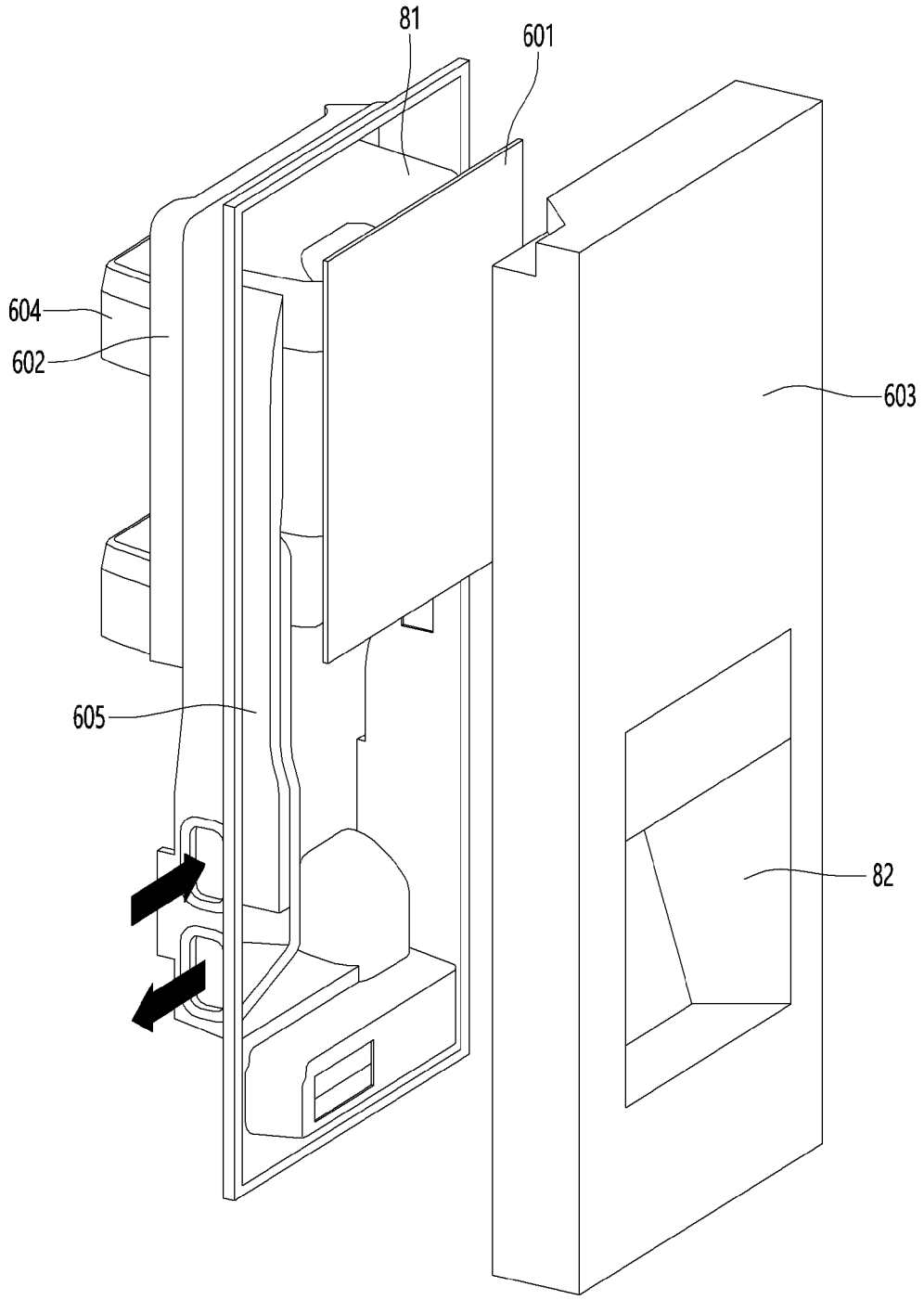

[Fig. 29]
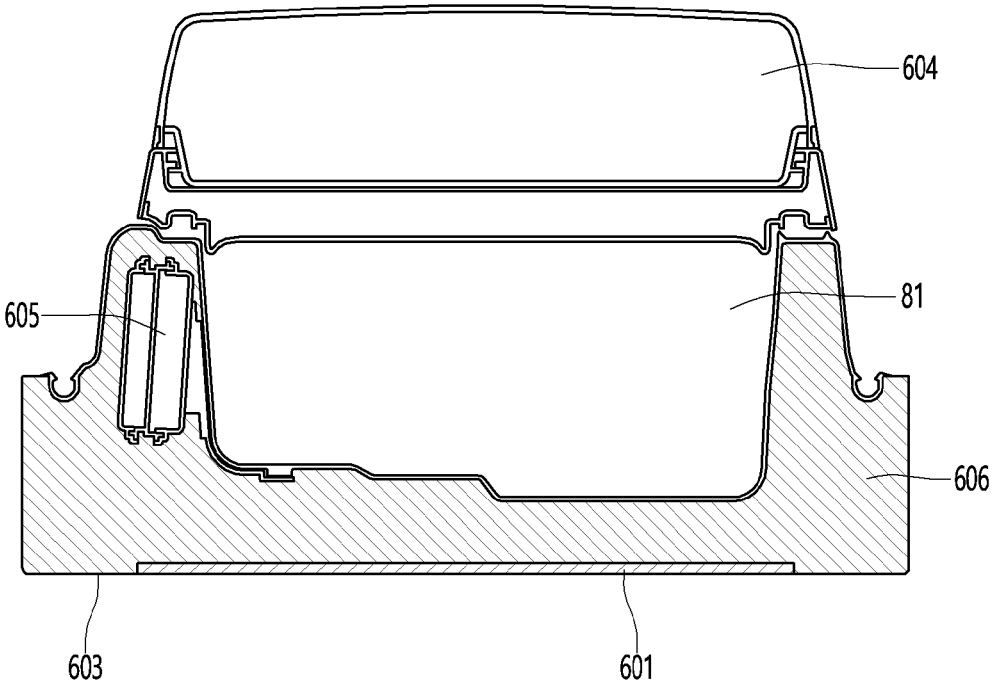

[Fig. 30]
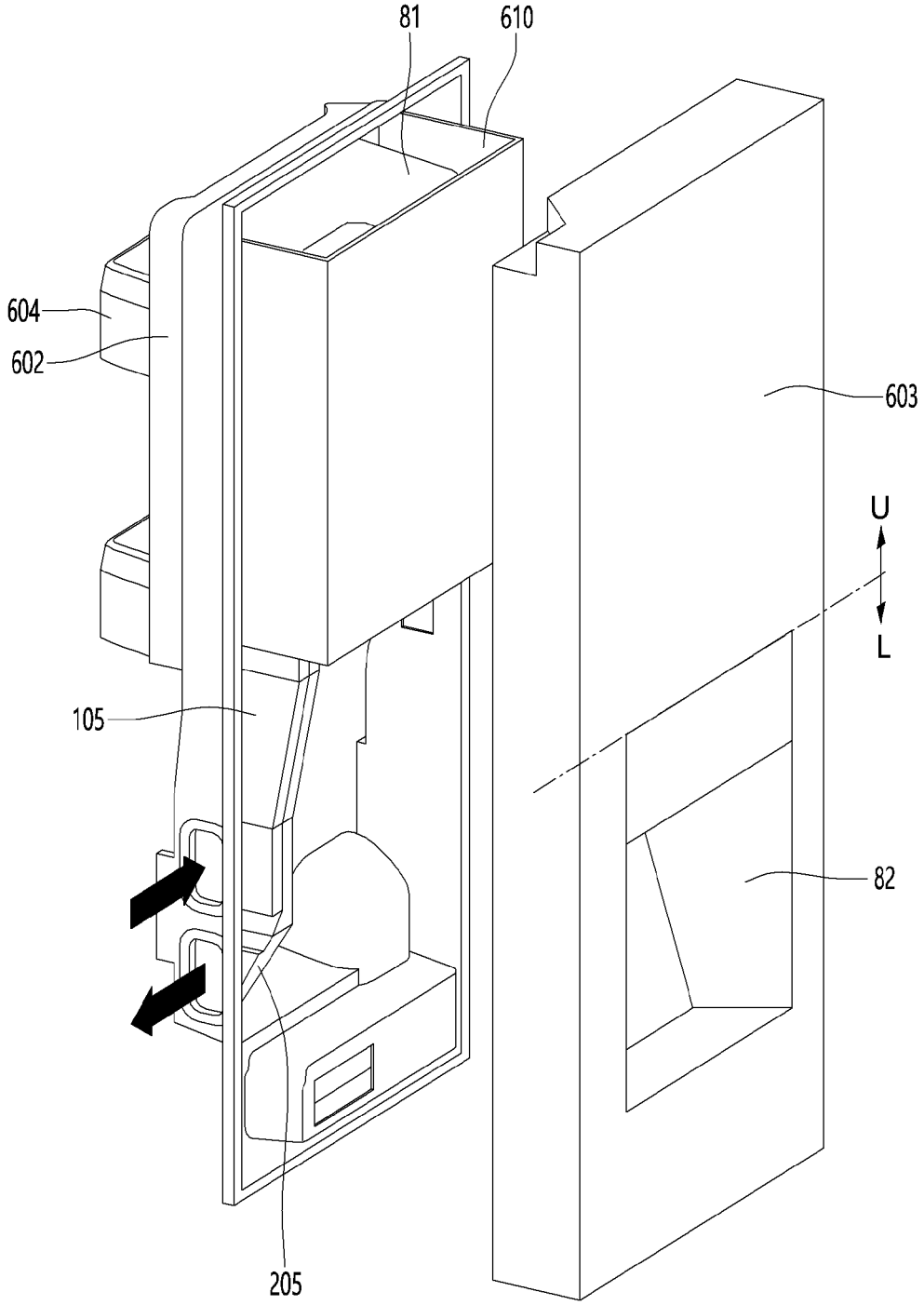

[Fig. 31]
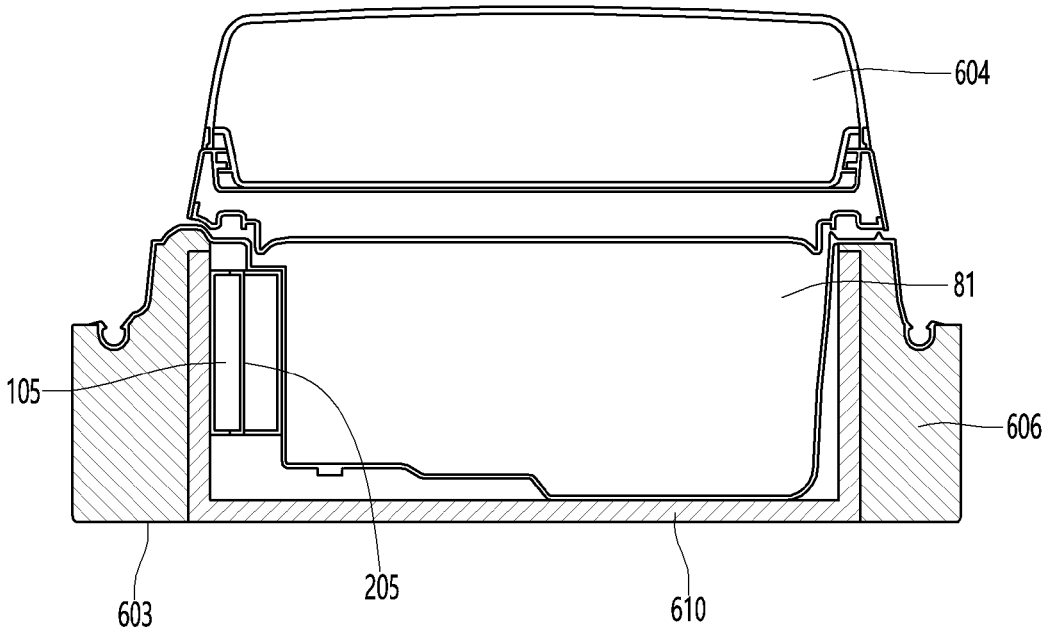
[Fig. 32]
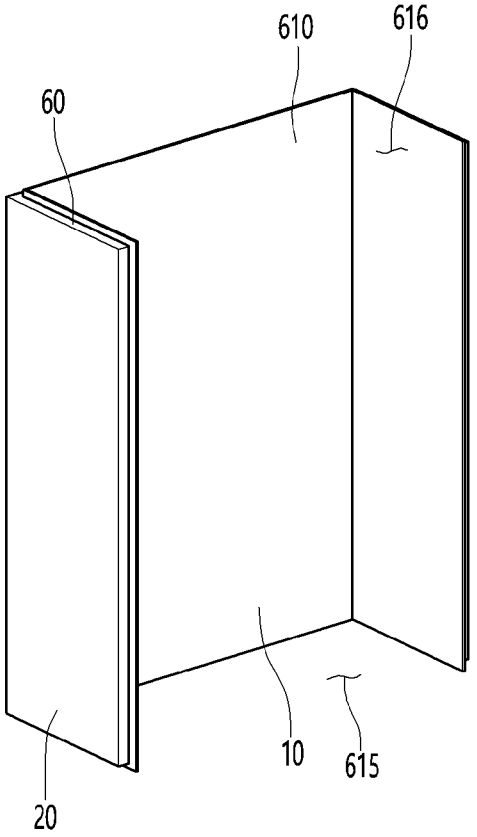

[Fig. 33]
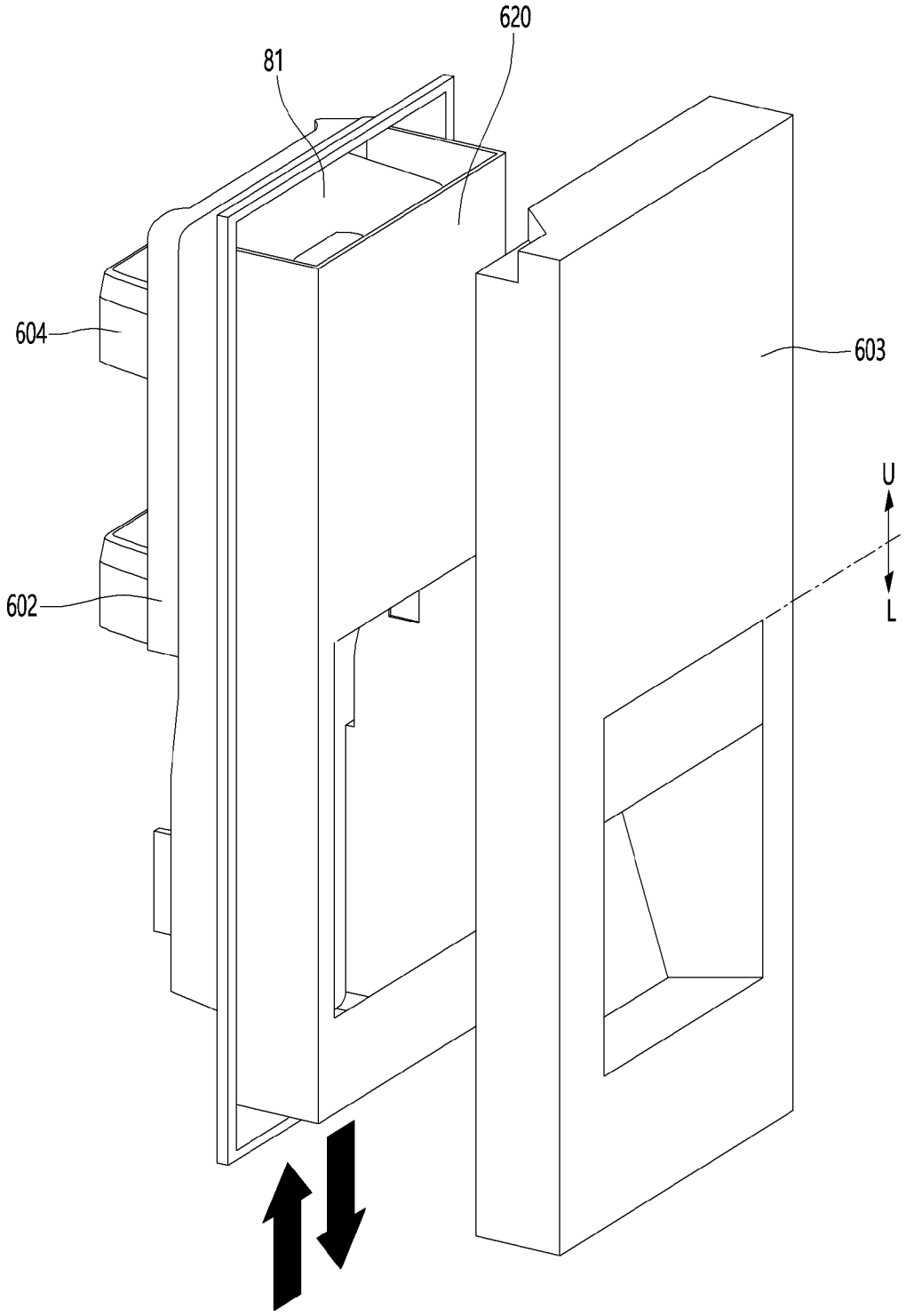

[Fig. 34]
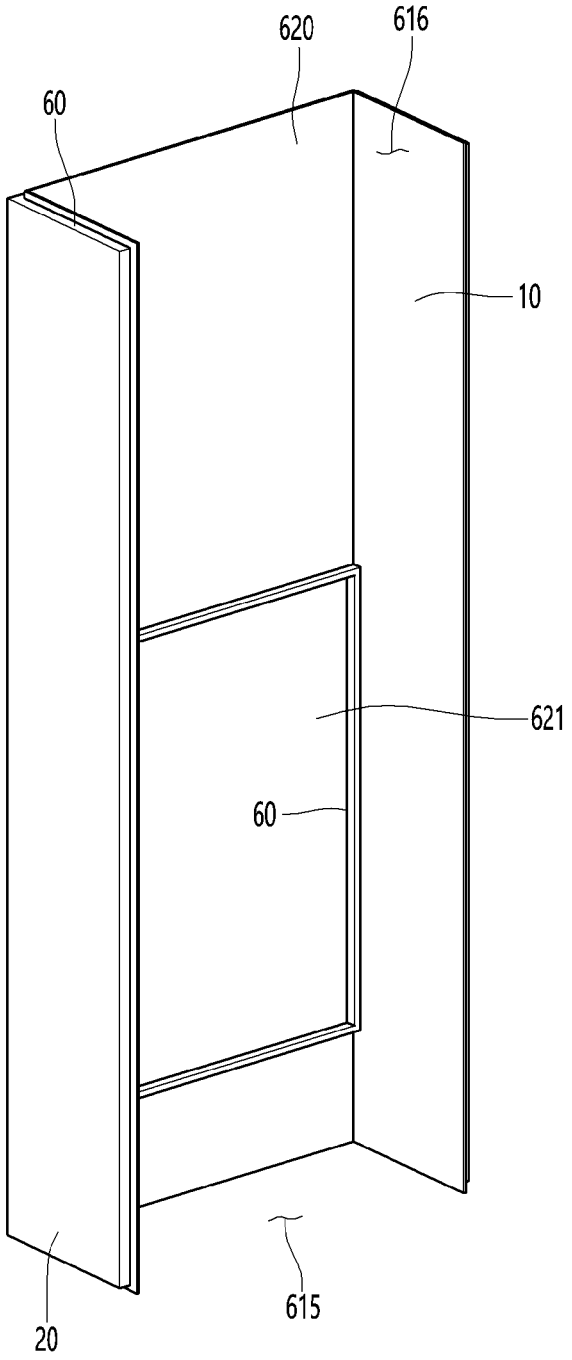

[Fig. 35]
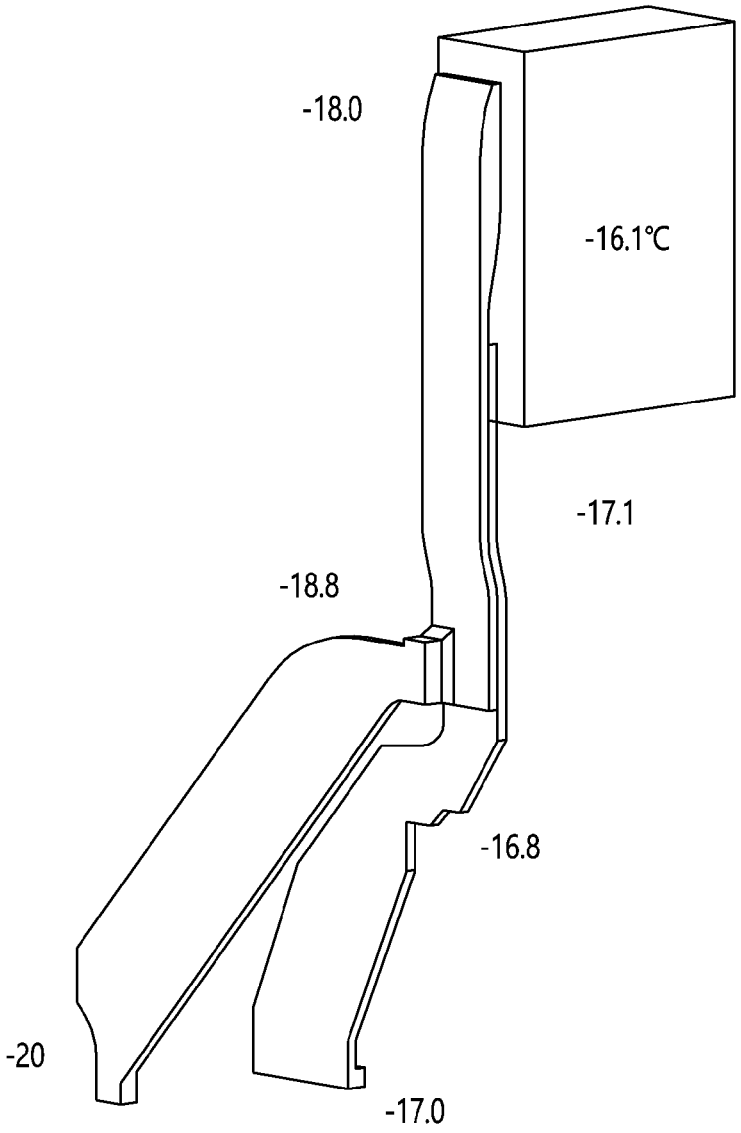

[Fig. 36]
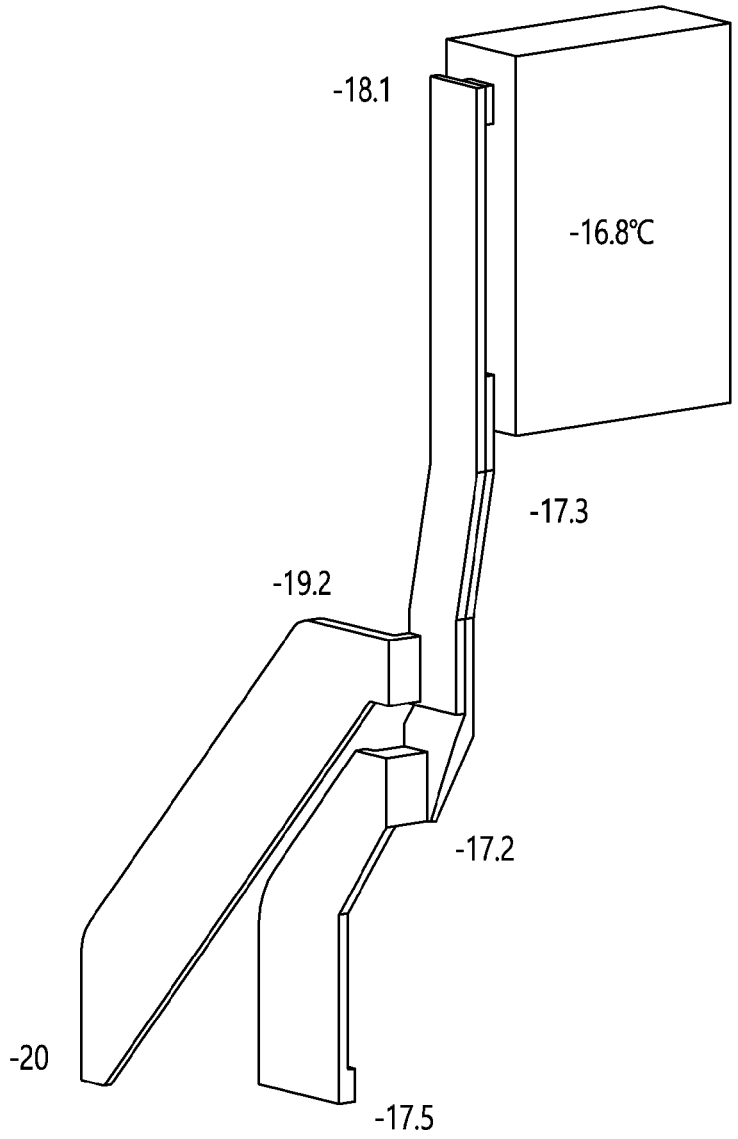

[Fig. 37]
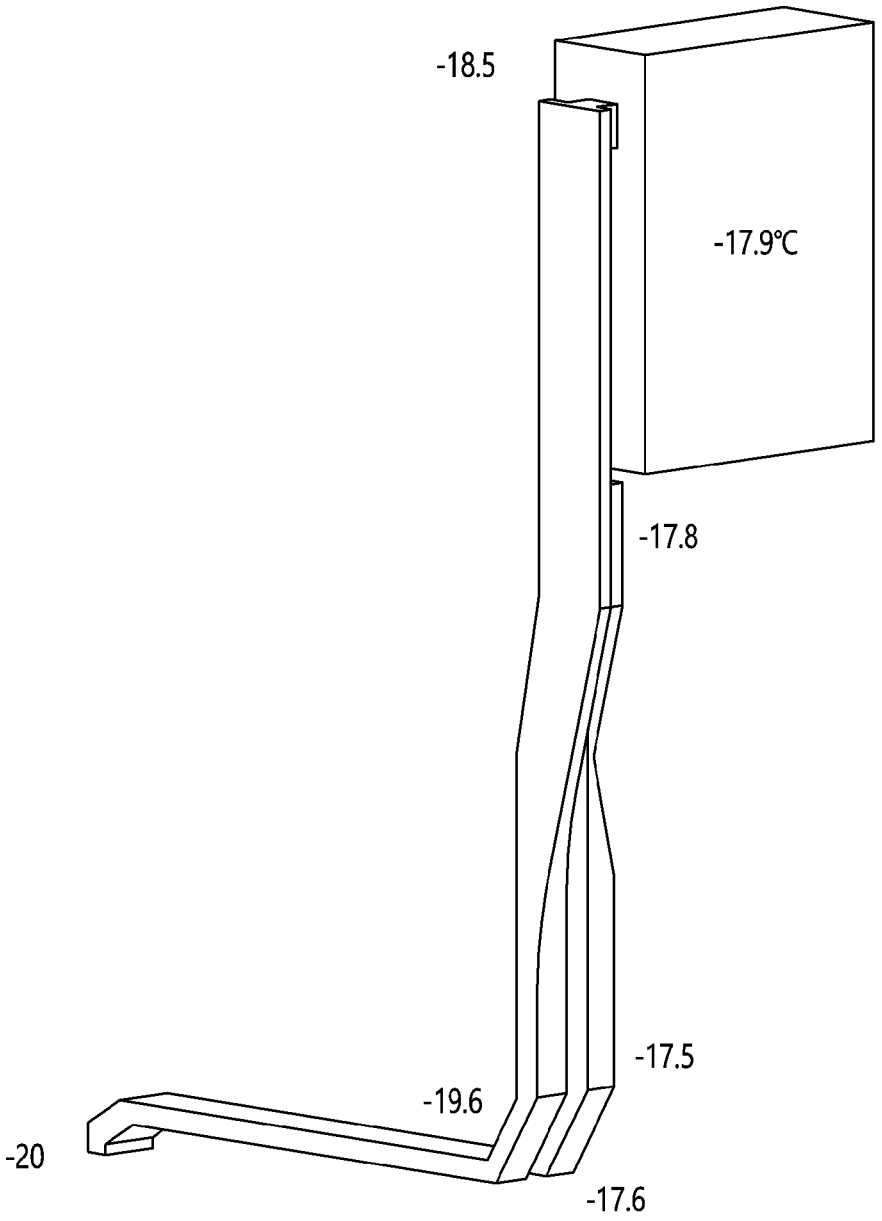

VACUUM ADIABATIC BODY AND REFRIGERATOR

CROSS-REFERENCE TO RELATED PATENT APPLICATIONS

This application is a U.S. National Stage Application under 35 U.S.C. § 371 of PCT Application No. PCT/KR2020/008973, filed Jul. 9, 2020, which claims priority to Korean Patent Application No. 10-2019-0082645, filed Jul. 9, 2019, whose entire disclosures are hereby incorporated by reference.

TECHNICAL FIELD

The present disclosure relates to a vacuum adiabatic body and a refrigerator.

BACKGROUND ART

A vacuum adiabatic body is a product for suppressing heat transfer by vacuuming the inside of a main body thereof. The vacuum adiabatic body may reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced.

In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the outside of the vacuum adiabatic panel is finished with a separate molding as Styrofoam. According to the method, additional foaming is not required, and the adiabatic performance of the refrigerator is improved. However, fabrication cost increases, and a fabrication method is complicated.

As another example, a technique of providing walls using a vacuum adiabatic material and additionally providing adiabatic walls using a foam filling material has been disclosed in Korean Patent Publication No. 10-2015-0012712 (Reference Document 2). Also, fabrication cost increases, and a fabrication method is complicated.

As further another example, there is an attempt to fabricate all walls of a refrigerator using a vacuum adiabatic body that is a single product. For example, a technique of providing an adiabatic structure of a refrigerator to be in a vacuum state has been disclosed in U.S. Patent Laid-Open Publication No. US2004/0226956A1 (Reference Document 3). However, it is difficult to obtain a practical level of an adiabatic effect by providing a wall of the refrigerator with sufficient vacuum. In detail, there are limitations that it is difficult to prevent a heat transfer phenomenon at a contact portion between an outer case and an inner case having different temperatures, it is difficult to maintain a stable vacuum state, and it is difficult to prevent deformation of a case due to a negative pressure of the vacuum state. Due to these limitations, the technology disclosed in Reference Document 3 is limited to a cryogenic refrigerator, and does not provide a level of technology applicable to general households.

Alternatively, the present applicant has applied for Korean Patent Publication No. 10-2017-0016187 (Reference Document 4) that discloses a vacuum adiabatic body and a refrigerator. This reference document proposes a single cooling space that is constructed using a single vacuum adiabatic body. However, a real refrigerator needs to be provided with a plurality of storage spaces having different temperatures, but there is a limitation that the conventional documents do not consider it.

On the other hand, in recent years, an ice maker is installed in the refrigerator so that consumers conveniently obtain ice. As a conventional technique related to the ice maker and the supply of the cool air to the ice maker, a cool air passage structure of a refrigerator, which is disclosed in KR Patent 10-2006-0041437 (Reference Document 5) and a refrigerator in which an ice maker is installed in a main body of the refrigerator, which is disclosed in KR Patent 10-2006-0076461 (Reference Document 6) have been proposed as a form in which the ice maker is installed in a refrigerating compartment door of the refrigerator.

In the related art, a duct is embedded in a foam portion providing a wall of the refrigerator, and cool air is supplied to the ice maker installed in the refrigerating compartment or the ice maker installed in the freezing compartment via the embedded duct.

According to the above technology, there is a limitation in that an inner space of the duct is reduced on the whole because it is difficult to thermally insulate the ducts to increase in a loss of cool air to the outside, and a thickness of the foam portion needs to increase so as to thermally insulate the duct. In addition, in the case of a vacuum adiabatic body, since an inner space of a vacuum space, which is an adiabatic space, is narrow and thin, it is impossible to embed the ducts in the first place.

DISCLOSURE OF INVENTION

Technical Problem

Embodiments provide a refrigerator in which a limitation, in which an ice-making cool air passage connecting an evaporator to an ice maker is not placed in a narrow wall of a vacuum space of a vacuum adiabatic body, is solved.

Embodiments also provide a refrigerator in which a limitation, in which an article accommodation space of the refrigerator, in which a vacuum adiabatic body is provided in a main body, is reduced due to occupancy of an ice-making cool air passage, is solved.

Embodiments also provide an ice maker in which a cool air loss occurring while ice-making cool air is guided is reduced to supply low-temperature cool air as much as possible to the ice maker, thereby providing a sufficient amount of ice.

Solution to Problem

In one embodiment, a vacuum adiabatic body includes: an inner space having an adiabatic wall as a vacuum space; a mullion configured to divide the space within the refrigerator into a refrigerating compartment and a freezing compartment; an ice maker placed in the freezing compartment; and an ice-making cool air passage passing through the mullion to connect the freezing compartment to the ice maker. Accordingly, ice-making cool air may be guided to the ice maker in a state of being thermally insulated with respect to a space within a refrigerator without passing through the vacuum space in which an adiabatic wall of the vacuum adiabatic body is provided. The mullion may be referred to as a partition that partitions a space.

The ice-making cool air passage may extend along an inner surface of the vacuum adiabatic body to maximize an adiabatic effect of the vacuum adiabatic body.

The ice-making cool air passage may extend along the mullion so that the adiabatic effect is utilized for thermal insulating the ice-making cool air by the mullion, and a cool air loss of the ice-making cool air is reduced.

The ice-making cool air passage may be completely accommodated in the mullion to reduce the adiabatic loss.

The ice-making cool air passage may have a flat and narrow cross-section that is wide in one direction to secure a flow rate of cool air that is required for making ice even though the ice-making cool air passage is inserted into a narrow space.

In another embodiment, a refrigerator includes: a vacuum adiabatic body comprising a freezing compartment and a freezing compartment, which are partitioned from each other; a mullion configured to partition the refrigerating compartment from the freezing compartment; an evaporator placed in the freezing compartment to generate cool air; a door configured to open and close the refrigerating compartment; an ice maker installed in the door; and an ice-making cool air passage of which at least a portion passes through the mullion to guide cool air generated in the evaporator to the ice maker. Accordingly, the ice-making cool air may be guided to the ice maker of the refrigerating compartment in a state of being thermally insulated with respect to a space within a refrigerator without passing through the vacuum space in which an adiabatic wall of the vacuum adiabatic body is provided.

The ice-making cool air passage may be accommodated in a side panel of the refrigerating compartment to prevent an internal temperature of the refrigerating compartment from being affected to the ice-making cool air without using a separate portion.

A foamed side panel adiabatic material may be configured to surround at least a portion of the ice-making cool air passage in the side panel, thereby significantly improving the adiabatic effect of the ice-making cool air passage.

The side panel dielectric material may be foamed to surround the ice-making cool air passage and then be installed in the refrigerating compartment. Accordingly, the ice-making cool air passage and the side panel adiabatic material may be easily installed to prevent a gas from occurring, thereby more significantly improving the adiabatic effect of the ice-making cool air.

The mullion may include a mullion panel and a mullion adiabatic material foamed in the mullion panel to more significantly improve the adiabatic effect of the ice-making cool air passage.

The mullion adiabatic material and the side panel adiabatic material may be foamed together to the number of processes and fabrication costs and reduce a gap between the foamed portions, thereby improving the adiabatic effect.

The ice-making cool air passage may include a pair of ice-making cool air passages that are led in and out to allow the passages to be spaced apart from each other.

The ice-making cool air passage may be connected to a door-side cool air passage on a side surface of the door to provide the cool air to the door-side ice maker.

The ice-making cool air passage may be connected to a door-side cool air passage on a bottom surface of the door to provide the cool air to the door-side ice maker.

A switchable switching door structure may be provided on at least one of connection portions of the ice-making cool air passage and the door-side cool air passage to prevent the cool air from leaking, promote the adiabatic effect, and prevent foreign substance from being permeated.

The vacuum adiabatic body may include: a first plate configured to define at least a portion of a wall for the accommodation space providing the refrigerating compartment and the freezing compartment; a second plate configured to define at least a portion of a wall for a space within the refrigerator, which has a temperature different from that of the accommodation space; a seal configured to seal the first plate and the second plate so as to provide a vacuum space that has a temperature between the temperature of the accommodation space and the temperature of the space within the refrigerator and is in a vacuum state; a support configured to maintain the vacuum space; a conductive resistance sheet configured to connect the first plate to the second plate so as to reduce a heat transfer amount between the first plate and the second plate; and an exhaust port configured to discharge a gas in the vacuum space, thereby significantly improving the adiabatic effect by a high vacuum state.

The door may a three-dimensional vacuum adiabatic module The three-dimensional vacuum adiabatic module may be configured to surround a front surface and a side surface of the door to improve the door-side adiabatic effect. The three-dimensional vacuum adiabatic module may improve the adiabatic effect required for the ice maker installed in the door. Accordingly, the ice maker may have larger ice-making capacity.

The three-dimensional vacuum adiabatic module may include a window dispenser having an opened front surface. The window dispenser may improve the overall adiabatic effect of the door to increase in performance of use of the ice maker.

In further another embodiment, a refrigerator includes an ice-making cool air passage passing through a boundary between a first vacuum adiabatic body and a second vacuum adiabatic body to guide cool air of a freezing space to an ice maker. Accordingly, the cool air may be supplied to the ice maker without passing through an adiabatic wall between the freezing space and the refrigerating space. Accordingly, an interference of the adiabatic wall due to the ice-making cool air passage may be reduced to improve an adiabatic performance.

The vacuum space of the first vacuum adiabatic body and the vacuum space of the second vacuum adiabatic body may communicate with each other to provide the vacuum space by using one wall for a single space. In this case, it may be unnecessary to fabricate the vacuum adiabatic body that is difficult to be fabricated. Accordingly, fabrication costs may be reduced, and convenience may be improved because it is unnecessary to provide a plurality of opening in the plurality of walls.

Advantageous Effects of Invention

According to the embodiment, the ice-making cool air passage may be guided to the ice maker in the state of being sufficiently insulated from the boundary between the refrigerating compartment and the freezing compartment. Therefore, the adiabatic loss may be reduced, and the space may be more largely utilized.

According to the embodiment, the structure in which the ice-making cool air passage is accommodated may be provided to other components that are essentially required for the refrigerator to which the vacuum adiabatic body is applied. Therefore, the ice-making cool air passage may be provided without interfering with the article accommodation space within the refrigerator.

According to the embodiment, the ice maker may operate with the relatively small adiabatic loss to improve the ice-making capacity. Therefore, it is possible to obtain the refrigerator that realizes the higher energy efficiency.

BRIEF DESCRIPTION OF DRAWINGS

FIG. 1 is a perspective view of a refrigerator according to an embodiment.

FIG. 2 is a view schematically illustrating a vacuum adiabatic body used in a main body and a door of the refrigerator.

FIG. 3 is a view illustrating an internal configuration of a vacuum space according to various embodiments.

FIG. 4 is a view illustrating a conductive resistance sheet and a peripheral portion thereof according to various embodiments.

FIG. 5 is a graph illustrating a variation in adiabatic performance and a variation in gas conductivity according to a vacuum pressure by applying a simulation.

FIG. 6 is a graph illustrating results obtained by observing a time and a pressure in a process of exhausting the inside of the vacuum adiabatic body when a support is used.

FIG. 7 is a graph illustrating results obtained by comparing a vacuum pressure to gas conductivity.

FIG. 8 is a schematic perspective view of an ice-making cool air passage in the refrigerator according to an embodiment.

FIG. 9 is a schematic cross-sectional view of a freezing compartment-side ice-making cool air passage in the refrigerator according to an embodiment.

FIG. 10 is a schematic cross-sectional view of a refrigerating compartment-side ice-making cool air passage in the refrigerator according to an embodiment.

FIG. 11 is a front perspective view illustrating a connection end between first and second ice-making cool air passage in the refrigerator.

FIG. 12 is a rear perspective view illustrating a connection end between first and second door-side ice-making cool air passage in the refrigerator.

FIG. 13 is a view for explaining a relationship between the ice-making cool air passage and a mullion.

FIG. 14 is a view for explaining a structure on which the mullion is seated.

FIG. 15 is a side perspective view for explaining an installation of the ice-making cool air passage and an adiabatic structure in the refrigerator.

FIG. 16 is a schematic perspective view of an ice-making cool air passage in a refrigerator according to another embodiment.

FIG. 17 is a view illustrating a relationship between a mullion and a door according to another embodiment.

FIGS. 18 and 19 are views for explaining a switching structure of the ice-making cool air passage, wherein FIG. 18 is a view illustrating a mullion side, and FIG. 19 is a view illustrating a door side.

FIG. 20 is a perspective view of a refrigerator in which each vacuum adiabatic body provides each storage space.

FIG. 21 is a perspective view of the refrigerator in a state in which a gap maintenance portion is provided at a connection portion between the vacuum adiabatic bodies.

FIG. 22 is an enlarged view of an ice-making connection passage.

FIG. 23 is a cross-sectional view of the ice-making connection passage, taken along line A-A'.

FIGS. 24 to 27 are views of a refrigerator in which a freezing compartment and a freezing compartment are respectively provided by two vacuum adiabatic bodies as illustrated in FIGS. 20 to 23, wherein the ice-making cool air passage is provided in a bottom surface of the door according to an embodiment.

FIG. 28 is an exploded perspective view illustrating a door of the ice-making cool air passage embedded in a foaming material.

FIG. 29 is a horizontal cross-sectional view of a space in which an ice maker is installed in FIG. 28.

FIG. 30 is an exploded perspective view of a door according to an embodiment.

FIG. 31 is a horizontal cross-sectional view of the space in which the ice maker is installed according to an embodiment.

FIG. 32 is a perspective view of a first vacuum adiabatic module according to an embodiment.

FIG. 33 is an exploded perspective view of a door according to another embodiment.

FIG. 34 is a perspective view of a first vacuum adiabatic module according to another embodiment.

FIGS. 35 to 37 are views illustrating heat efficiency of the ice-making cool air passage embedded in the forming material and the ice-making cool air passage according to an embodiment, wherein FIG. 35 illustrates a case in which the ice-making cooling passage embedded in the forming material and an adiabatic panel are installed, FIG. 36 illustrates a case in which the side panel ice-making cool air passage and a first vacuum adiabatic module are installed, and FIG. 37 illustrates a case in which the mullion ice-making cool air passage and a second vacuum adiabatic module are installed.

MODE FOR THE INVENTION

Hereinafter, exemplary embodiments will be described with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

Hereinafter, for description of embodiments, the drawings shown below may be displayed differently from the actual product, or exaggerated or simple or detailed parts may be deleted, but this is intended to facilitate understanding of the technical idea of the present invention. It should not be construed as limited. However, it will try to show the actual shape as much as possible.

The following embodiments may be applied to the description of another embodiment unless the other embodiment does not collide with each other, and some configurations of any one of the embodiments may be modified in a state in which only a specific portion is modified in another configuration may be applied.

In the following description, the vacuum pressure means any pressure state lower than the atmospheric pressure. In addition, the expression that a vacuum degree of A is higher than that of B means that a vacuum pressure of A is lower than that of B.

FIG. 1 is a perspective view of a refrigerator according to an embodiment.

Referring to FIG. 1, the refrigerator 1 includes a main body 2 provided with a cavity 9 capable of storing storage goods and a door 3 provided to open and close the main body 2. The door 3 may be rotatably or slidably movably disposed to open/close the cavity 9. The cavity 9 may provide at least one of a refrigerating compartment and a freezing compartment.

Components constituting a refrigeration cycle in which cool air is supplied into the cavity 9. In detail, the components include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

FIG. 2 is a view schematically illustrating a vacuum adiabatic body used in the main body and the door of the refrigerator. In FIG. 2, a main body-side vacuum adiabatic body is illustrated in a state in which walls of top and side surfaces are removed, and a door-side vacuum adiabatic body is illustrated in a state in which a portion of a wall of a front surface is removed. In addition, sections of portions at conductive resistance sheets are provided are schematically illustrated for convenience of understanding.

Referring to FIG. 2, the vacuum adiabatic body includes a first plate 10 for providing a wall of a low-temperature space, a second plate 20 for providing a wall of a high-temperature space, a vacuum space 50 defined as a gap between the first and second plates 10 and 20. Also, the vacuum adiabatic body includes the conductive resistance sheets 60 and 63 for preventing heat conduction between the first and second plates 10 and 20. A seal 61 for sealing the first and second plates 10 and 20 is provided so that the vacuum space 50 is in a sealing state. When the vacuum adiabatic body is applied to a refrigerator or a heating cabinet, the first plate 10 may be referred to as an inner case that is installed inside a control space controlling a temperature, and the second plate 20 may be referred to as an outer case that is installed outside the control space. A machine room 8 in which components providing a refrigeration cycle are accommodated is placed at a lower rear side of the main body-side vacuum adiabatic body, and an exhaust port 40 for forming a vacuum state by exhausting air in the vacuum space 50 is provided at any one side of the vacuum adiabatic body. In addition, a pipeline 64 passing through the vacuum space 50 may be further installed so as to install a defrosting water line and electric wires.

The first plate 10 may define at least a portion of a wall for a first space provided thereto. The second plate 20 may define at least a portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are heat conduction between the first and second plates 10 and 20, heat radiation between the first and second plates 10 and 20, and gas conduction of the vacuum space 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

FIG. 3 is a view illustrating an internal configuration of the vacuum space according to various embodiments.

First, referring to FIG. 3A, the vacuum space 50 may be provided in a third space having a pressure different from that of each of the first and second spaces, preferably, a vacuum state, thereby reducing an adiabatic loss. The third space may be provided at a temperature between the temperature of the first space and the temperature of the second space. Since the third space is provided as a space in the vacuum state, the first and second plates 10 and 20 receive a force contracting in a direction in which they approach each other due to a force corresponding to a pressure difference between the first and second spaces. Therefore, the vacuum space 50 may be deformed in a direction in which the vacuum space 50 is reduced in volume. In this case, the adiabatic loss may be caused due to an increase in amount of heat radiation, caused by the contraction of the vacuum space 50, and an increase in amount of heat conduction, which is caused by contact between the plates 10 and 20.

The support 30 may be provided to reduce the deformation of the vacuum space 50. The support 30 includes a bar 31. The bar 31 may extend in a substantially vertical direction with respect to the plates to support a distance between the first plate and the second plate. A support plate 35 may be additionally provided on at least any one end of the bar 31. The support plate 35 may connect at least two or more bars 31 to each other to extend in a horizontal direction with respect to the first and second plates 10 and 20. The support plate 35 may be provided in a plate shape or may be provided in a lattice shape so that an area of the support plate contacting the first or second plate 10 or 20 decreases, thereby reducing heat transfer. The bars 31 and the support plate 35 are fixed to each other at at least a portion so as to be inserted together between the first and second plates 10 and 20. The support plate 35 contacts at least one of the first and second plates 10 and 20, thereby preventing the deformation of the first and second plates 10 and 20. In addition, based on the extension direction of the bars 31, a total sectional area of the support plate 35 is provided to be greater than that of the bars 31, so that heat transferred through the bars 31 may be diffused through the support plate 35.

The support 30 may be made of a resin selected from PC, glass fiber PC, low outgassing PC, PPS, and LCP to obtain high compressive strength, a low outgassing and water absorption rate, low thermal conductivity, high compressive strength at a high temperature, and superior processability.

A radiation resistance sheet 32 for reducing heat radiation between the first and second plates 10 and 20 through the vacuum space 50 will be described. The first and second plates 10 and 20 may be made of a stainless material capable of preventing corrosion and providing a sufficient strength. Since the stainless material has a relatively high emissivity of 0.16, a large amount of radiation heat may be transferred. In addition, the support 30 made of the resin has a lower emissivity than the plates, and is not entirely provided to inner surfaces of the first and second plates 10 and 20. Thus, the support 30 does not have great influence on the radiation heat. Therefore, the radiation resistance sheet 32 may be provided in a plate shape over a majority of the area of the vacuum space 50 so as to concentrate on reduction of radiation heat transferred between the first and second plates 10 and 20. A product having a low emissivity may be used as the material of the radiation resistance sheet 32. In an embodiment, an aluminum foil having an emissivity of 0.02 may be used as the radiation resistance sheet 32. Also, since the transfer of radiation heat may not be sufficiently blocked using one radiation resistance sheet, at least two radiation resistance sheets 32 may be provided at a certain distance so as not to contact each other. Also, at least one radiation resistance sheet may be provided in a state of contacting the inner surface of the first or second plate 10 or 20.

Referring back FIG. 3*b*, the distance between the plates is maintained by the support 30, and a porous material 33 may be filled in the vacuum space 50. The porous material 33 may have a higher emissivity than that of the stainless material of the first and second plates 10 and 20. However, since the porous material 33 is filled in the vacuum space 50, the porous material 33 has a high efficiency for resisting the radiation heat transfer.

In this embodiment, the vacuum adiabatic body may be fabricated without the radiation resistance sheet 32.

Referring to FIG. 3*c*, the support 30 for maintaining the vacuum space 50 may not be provided. A porous material 333 may be provided to be surrounded by a film 34 instead of the support 30. Here, the porous material 33 may be provided in a state of being compressed so that the gap of the vacuum space is maintained. The film 34 made of, for example, a PE material may be provided in a state in which a hole is punched in the film 34.

In this embodiment, the vacuum adiabatic body may be fabricated without the support 30. That is to say, the porous material 33 may perform the function of the radiation resistance sheet 32 and the function of the support 30 together.

FIG. 4 is a view illustrating the conductive resistance sheet and the peripheral portion thereof according to various embodiments. A structure of each of the conductive resistance sheets are briefly illustrated in FIG. 2, but will be understood in detail with reference to the drawings.

First, a conductive resistance sheet proposed in FIG. 4*a* may be applied to the main body-side vacuum adiabatic body. Specifically, the first and second plates 10 and 20 are to be sealed so as to vacuum the inside of the vacuum adiabatic body. In this case, since the two plates have different temperatures from each other, heat transfer may occur between the two plates. A conductive resistance sheet 60 is provided to prevent heat conduction between different two kinds of plates.

The conductive resistance sheet 60 may be provided with the seal 61 at which both ends of the conductive resistance sheet 60 are sealed to define at least a portion of the wall for the third space and maintain the vacuum state. The conductive resistance sheet 60 may be provided as a thin foil in unit of micrometer so as to reduce the amount of heat conducted along the wall for the third space. The seals 610 may be provided as a weld. That is, the conductive resistance sheet 60 and the plates 10 and 20 may be fused to each other. To cause a fusing operation between the conductive resistance sheet 60 and the plates 10 and 20, the conductive resistance sheet 60 and the plates 10 and 20 may be made of the same material, and a stainless material may be used as the material. The seal 610 may not be limited to the weld and may be provided through a process such as cocking. The conductive resistance sheet 60 may be provided in a curved shape. Thus, a heat conduction distance of the conductive resistance sheet 60 is provided longer than a linear distance of each of the plates so that an amount of heat conduction is further reduced.

A change in temperature occurs along the conductive resistance sheet 60. Therefore, to block the heat transfer to the outside of the conductive resistance sheet 60, a shield 62 may be provided at the outside of the conductive resistance sheet 60 so that an adiabatic operation occurs. In other words, in case of the refrigerator, the second plate 20 has a high temperature, and the first plate 10 has a low temperature. In addition, heat conduction from high temperature to low temperature occurs in the conductive resistance sheet 60, and thus the temperature of the conductive resistance sheet 60 is suddenly changed. Therefore, when the conductive resistance sheet 60 is opened with respect to the outside thereof, the heat transfer through the opened place may seriously occur. To reduce the heat loss, the shield 62 is provided outside the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shield 62 may be provided as a porous material contacting an outer surface of the conductive resistance sheet 60. The shield 62 may be provided as an adiabatic structure, e.g., a separate gasket, which is placed at the outside of the conductive resistance sheet 60. The shield 62 may be provided as a portion of the vacuum adiabatic body, which is provided at a position facing a corresponding conductive resistance sheet 60 when the main body-side vacuum adiabatic body is closed with respect to the door-side vacuum adiabatic body. To reduce the heat loss even when the main body and the door are opened, the shield 62 may be provided as a porous material or a separate adiabatic structure.

A conductive resistance sheet proposed in FIG. 4*b* may be applied to the door-side vacuum adiabatic body. In FIG. 4*b*, portions different from those of FIG. 4*a* are described in detail, and the same description is applied to portions identical to those of FIG. 4*a*. A side frame 70 is further provided outside the conductive resistance sheet 60. A component for the sealing between the door and the main body, an exhaust port necessary for an exhaust process, a getter port for vacuum maintenance, and the like may be placed on the side frame 70. This is because the mounting of components is convenient in the main body-side vacuum adiabatic body, but the mounting positions of components are limited in the door-side vacuum adiabatic body.

In the door-side vacuum adiabatic body, it is difficult to place the conductive resistance sheet 60 on a front end of the vacuum space, i.e., an edge side surface of the vacuum space. This is because, unlike the main body, a corner edge of the door is exposed to the outside. In more detail, if the conductive resistance sheet 60 is placed on the front end of the vacuum space, the corner edge of the door is exposed to the outside, and hence there is a disadvantage in that a separate adiabatic portion has to be configured so as to thermally insulate the conductive resistance sheet 60.

A conductive resistance sheet proposed in FIG. 4*c* may be installed in the pipeline passing through the vacuum space. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path may be lengthened, and deformation caused by a pressure difference may be prevented. In addition, a separate shield may be provided to improve the adiabatic performance of the conductive resistance sheet.

A heat transfer path between the first and second plates 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, support conduction heat ② conducted along the support 30 provided inside the vacuum adiabatic body, gas conduction heat ③ conducted through an internal gas in the vacuum space, and radiation transfer heat ④ transferred through the vacuum space.

The transfer heat may be changed depending on various depending on various design dimensions. For example, the support may be changed so that the first and second plates 10 and 20 may endure a vacuum pressure without being deformed, the vacuum pressure may be changed, the distance between the plates may be changed, and the length of the conductive resistance sheet may be changed. The transfer heat may be changed depending on a difference in temperature between the spaces (the first and second spaces) respectively provided by the plates. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ may become the smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the support conduction heat ② is the largest. For example, the heat transfer amount by the solid conduction heat may reach 75% of the total heat transfer amount. A heat transfer amount by the radiation transfer heat ③ is smaller than the heat transfer amount by the solid conduction heat but larger than the heat transfer amount of the gas conduction heat. For example, the heat transfer amount by the radiation transfer heat ③ may occupy about 20% of the total heat transfer amount.

According to the heat transfer distribution, effective heat transfer coefficients (eK: effective K) (W/mK) of the surface conduction heat ①, the support conduction heat ②, the gas conduction heat ③, and the radiation transfer heat ④ may have an order of Math Equation 1 when comparing the transfer heat ①, ②, ③, and ④.

$$eK_{solid\ conduction\ heat} > eK_{radiation\ conduction\ heat} > eK_{gas\ conduction\ heat} \quad \text{[Equation 1]}$$

Here, the effective heat transfer coefficient (eK) is a value that may be measured using a shape and temperature differences of a target product. The effective heat transfer coefficient (eK) is a value that may be obtained by measuring a total heat transfer amount and a temperature at least one portion at which heat is transferred. For example, a calorific value (W) is measured using a heating source that may be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area ($m^2$) of the vacuum adiabatic body, L denotes a thickness (m) of the vacuum adiabatic body, and $\Delta T$ denotes a temperature difference.

For the surface conduction heat, a conductive calorific value may be obtained through a temperature difference $\Delta T$ between an entrance and an exit of the conductive resistance sheet 60 or 63, a sectional area A of the conductive resistance sheet, a length L of the conductive resistance sheet, and a thermal conductivity (k) of the conductive resistance sheet (the thermal conductivity of the conductive resistance sheet is a material property of a material and may be obtained in advance). For the support conduction heat, a conductive calorific value may be obtained through a temperature difference $\Delta T$ between an entrance and an exit of the support 30, a sectional area A of the support, a length L of the support, and a thermal conductivity (k) of the support. Here, the thermal conductivity of the support may be a material property of a material and may be obtained in advance. The sum of the gas conduction heat ③, and the radiation transfer heat ④ may be obtained by subtracting the surface conduction heat and the support conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space 50.

When a porous material is provided inside the vacuum space 50, porous material conduction heat ⑤ may be a sum of the support conduction heat ② and the radiation transfer heat ④. The porous material conduction heat may be changed depending on various variables including a kind, an amount, and the like of the porous material.

According to an embodiment, a temperature difference $\Delta T_1$ between a geometric center formed by adjacent bars 31 and a point at which each of the bars 31 is located may be provided to be less than 0.5° C. Also, a temperature difference $\Delta T_2$ between the geometric center formed by the adjacent bars 31 and an edge of the vacuum adiabatic body may be provided to be less than 0.5° C. In the second plate 20, a temperature difference between an average temperature of the second plate and a temperature at a point at which a heat transfer path passing through the conductive resistance sheet 60 or 63 meets the second plate may be the largest. For example, when the second space is a region hotter than the first space, the temperature at the point at which the heat transfer path passing through the conductive resistance sheet meets the second plate becomes lowest. Similarly, when the second space is a region colder than the first space, the temperature at the point at which the heat transfer path passing through the conductive resistance sheet meets the second plate becomes highest.

This means that the amount of heat transferred through other points except the surface conduction heat passing through the conductive resistance sheet should be controlled, and the entire heat transfer amount satisfying the vacuum adiabatic body may be achieved only when the surface conduction heat occupies the largest heat transfer amount. For this, a temperature variation of the conductive resistance sheet may be controlled to be larger than that of the plate.

Physical characteristics of the components constituting the vacuum adiabatic body will be described. In the vacuum adiabatic body, force due to a vacuum pressure is applied to all of the components. Therefore, a material having a strength ($N/m^2$) of a certain level may be used.

Under such circumferences, the plates 10 and 20 and the side frame 70 may be made of a material having sufficient strength with which the plates 10 and 20 are not damaged by even the vacuum pressure. For example, when the number of bars 31 decreases to limit the support conduction heat, the deformation of each of the plates occurs due to the vacuum pressure, which may bad influence on an outer appearance of the refrigerator. The radiation resistance sheet 32 may be made of a material that has a low emissivity and may be easily subjected to thin film processing. Also, the radiation resistance sheet 32 has to ensure strength enough without being deformed by an external impact. The support 30 is provided to strength that is enough to support the force by the vacuum pressure and endure the external impact, and is to have processability. The conductive resistance sheet 60 may be made of a material that has a thin plate shape and may endure the vacuum pressure.

In an embodiment, the plate, the side frame, and the conductive resistance sheet may be made of stainless materials having the same strength. The radiation resistance sheet may be made of aluminum having weaker strength than that of each of the stainless materials. The support may be made of a resin having weaker strength than that of the aluminum.

Unlike the strength from the point of view of the materials, an analysis from the point of view of stiffness is required. The stiffness (N/m) may be a property that is not be easily deformed. Thus, although the same material is used, its stiffness may vary depending on its shape. The conductive resistance sheets 60 or 63 may be made of a material having strength, but the stiffness of the material may be low so as to increase in heat resistance and minimize the radiation heat as the conductive resistance sheet is uniformly spread without any roughness when the vacuum pressure is applied. The radiation resistance sheet 32 requires stiffness having a certain level so as not to contact another component due to deformation. Particularly, an edge of the radiation resistance sheet may generate the conduction heat due to drooping caused by the self-load of the radiation resistance sheet. Therefore, the stiffness having the certain level is required. The support 30 requires a stiffness enough to endure compressive stress from the plate and the external impact.

In an embodiment, the plate and the side frame may have the highest stiffness so as to prevent the deformation caused by the vacuum pressure. The support, particularly, the bar may have the second highest stiffness. The radiation resistance sheet may have stiffness that is lower than that of the support but higher than that of the conductive resistance sheet. Lastly, the conductive resistance sheet may be made of a material that is easily deformed by the vacuum pressure and has the lowest stiffness.

Even when the porous material 33 is filled in the vacuum space 50, the conductive resistance sheet may have the lowest stiffness, and each of the plate and the side frame may have the highest stiffness.

Hereinafter, the vacuum pressure may be determined depending on internal states of the vacuum adiabatic body. As already described above, a vacuum pressure is to be maintained inside the vacuum adiabatic body so as to reduce heat transfer. Here, it will be easily expected that the vacuum pressure is maintained as low as possible so as to reduce the heat transfer.

The vacuum space may resist to heat transfer by only the support 30. Here, a porous material 33 may be filled with the support inside the vacuum space 50 to resist to the heat transfer. The heat transfer to the porous material may resist without applying the support.

The case in which only the support is applied will be described.

FIG. 5 is a graph illustrating a variation in adiabatic performance and a variation in gas conductivity according to the vacuum pressure by applying a simulation.

Referring to FIG. 5, it may be seen that, as the vacuum pressure decreases, i.e., as the vacuum degree increases, a heat load in the case of only the main body (Graph 1) or in the case in which the main body and the door are combined together (Graph 2) decreases as compared to that in the case of the typical product formed by foaming polyurethane, thereby improving the adiabatic performance. However, it may be seen that the degree of improvement of the adiabatic performance is gradually lowered. Also, it may be seen that, as the vacuum pressure decreases, the gas conductivity (Graph 3) decreases. However, it may be seen that, although the vacuum pressure decreases, a ratio at which the adiabatic performance and the gas conductivity are improved is gradually lowered. Therefore, it is preferable that the vacuum pressure decreases as low as possible. However, it takes long time to obtain an excessive vacuum pressure, and much cost is consumed due to an excessive use of the getter. In the embodiment, an optimal vacuum pressure is proposed from the above-described point of view.

FIG. 6 is a graph illustrating results obtained by observing a time and a pressure in a process of exhausting the inside of the vacuum adiabatic body when the support is used.

Referring to FIG. 6, to create the vacuum space 50 to be in the vacuum state, a gas in the vacuum space 50 is exhausted by a vacuum pump while evaporating a latent gas remaining in the components of the vacuum space 50 through baking. However, if the vacuum pressure reaches a certain level or more, there exists a point at which the level of the vacuum pressure does not increase any more ($\Delta t_1$). Thereafter, the getter is activated by disconnecting the vacuum space 50 from the vacuum pump and applying heat to the vacuum space 50 ($\Delta t_2$). If the getter is activated, the pressure in the vacuum space 50 decreases for a certain period of time, but then normalized to maintain a vacuum pressure having a certain level. The vacuum pressure that maintains the certain level after the activation of the getter is approximately $1.8\times10^{-6}$ Torr.

In the embodiment, a point at which the vacuum pressure does not substantially decrease any more even though the gas is exhausted by operating the vacuum pump is set to the lowest limit of the vacuum pressure used in the vacuum adiabatic body, thereby setting the minimum internal pressure of the vacuum space 50 to $1.8\times10^{-6}$ Torr.

FIG. 7 is a graph illustrating results obtained by comparing the vacuum pressure with gas conductivity.

Referring to FIG. 7, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three sizes of 2.76 mm, 6.5 mm, and 12.5 mm. The gap in the vacuum space 50 is defined as follows. When the radiation resistance sheet 32 exists inside vacuum space 50, the gap is a distance between the radiation resistance sheet 32 and the plate adjacent thereto. When the radiation resistance sheet 32 does not exist inside vacuum space 50, the gap is a distance between the first and second plates.

It was seen that, since the size of the gap is small at a point corresponding to a typical effective heat transfer coefficient of 0.0196 W/mK, which is provided to an adiabatic material formed by foaming polyurethane, the vacuum pressure is $2.65\times10^{-1}$ Torr even when the size of the gap is 2.76 mm. Meanwhile, it was seen that the point at which reduction in adiabatic effect caused by the gas conduction heat is saturated even though the vacuum pressure decreases is a point at which the vacuum pressure is approximately $4.5\times10^{-3}$ Torr. The vacuum pressure of $4.5\times10^{-3}$ Torr may be defined as the point at which the reduction in adiabatic effect caused by the gas conduction heat is saturated. Also, when the effective heat transfer coefficient is 0.1 W/mK, the vacuum pressure is $1.2\times10^{-2}$ Torr.

When the vacuum space 50 is not provided with the support but provided with the porous material, the size of the gap ranges from a few micrometers to a few hundreds of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately $2.0\times10^{-4}$ Torr. Also, the vacuum pressure at the point at which the reduction in adiabatic effect caused by the gas conduction heat is saturated is approximately $4.7\times10^{-2}$ Torr. Also, the pressure where the reduction in adiabatic effect caused by gas conduction heat reaches the typical effective heat transfer coefficient of 0.0196 W/mK is 730 Torr.

When the support and the porous material are provided together in the vacuum space, a vacuum pressure may be created and used, which is middle between the vacuum pressure when only the support is used and the vacuum pressure when only the porous material is used. When only the porous material is used, the lowest vacuum pressure may be used.

The vacuum adiabatic body includes a first plate defining at least a portion of a wall for the first space and a second plate defining at least a portion of a wall for the second space and having a temperature different from the first space. The first plate may include a plurality of layers. The second plate may include a plurality of layers The vacuum adiabatic body may further include a seal configured to seal the first plate and the second plate so as to provide a third space that is in a vacuum state and has a temperature between a temperature of the first space and a temperature of the second space.

When one of the first plate and the second plate is disposed in an inner space of the third space, the plate may be represented as an inner plate. When the other one of the first plate and the second plate is disposed in an outer space of the third space, the plate may be represented as an outer plate. For example, the inner space of the third space may be a storage room of the refrigerator. The outer space of the third space may be an outer space of the refrigerator.

The vacuum adiabatic body may further include a support that maintains the third space.

The vacuum adiabatic body may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate.

At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate.

The more the conductive resistance sheet decreases in thickness, the more it may be difficult to couple the conductive resistance sheet between the first plate and the second plate.

One end of the conductive resistance sheet may be disposed to overlap at least a portion of the first plate. This is to provide a space for coupling one end of the conductive resistance sheet to the first plate. Here, the coupling method may include welding.

The other end of the conductive resistance sheet may be arranged to overlap at least a portion of the second plate. This is to provide a space for coupling the other end of the conductive resistance sheet to the second plate. Here, the coupling method may include welding.

As another embodiment of replacing the conductive resistance sheet, the conductive resistance sheet may be deleted, and one of the first plate and the second plate may be thinner than the other. In this case, any thickness may be greater than that of the conductive resistance sheet. In this case, any length may be greater than that of the conductive resistance sheet. With this configuration, it is possible to reduce the increase in heat transfer by deleting the conductive resistance sheet. Also, this configuration may reduce difficulty in coupling the first plate to the second plate.

At least a portion of the first plate and at least a portion of the second plate may be disposed to overlap each other. This is to provide a space for coupling the first plate to the second plate. An additional cover may be disposed on any one of the first plate and the second plate, which has a thin thickness. This is to protect the thin plate.

The vacuum adiabatic body may further include an exhaust port for discharging a gas in the vacuum space.

Hereinafter, as one embodiment, a detailed configuration of the refrigerator in which the vacuum adiabatic body is applied to at least the main body will be described. This embodiment illustrates a case in which an ice maker is installed in the refrigerating compartment door.

The ice maker may include a narrow-scale ice maker which receives cool air having a temperature of below zero and water to make ice and a board-scale ice maker including a dispensing structure for dispensing ice, a crusher that crushes ice, an ice bin containing ice, and a chute discharging ice.

This embodiment illustrates that the ice maker is installed in the refrigerating compartment door of the refrigerator in which the refrigerating compartment is disposed at an upper side, and the freezing compartment is disposed at a lower side. The ice maker may be provided in an upper portion of the refrigerating compartment door to perform a service so that ice drops downward through a dispenser disposed below the ice maker.

This embodiment is not limited to the above-mentioned range and may have various deformable applications.

FIG. 8 is a schematic perspective view of the ice-making cool air passage in the refrigerator according to an embodiment.

Referring to FIG. 8, the main body 2 and the door 3 are provided in the refrigerator, and the main body 2 and the door 3 may be provided as vacuum adiabatic bodies according to an embodiment. The main body 2 may be divided vertically by the mullion 300. A lower accommodation space may be provided as a freezing compartment F, and an upper compartment accommodation space may be provided as a refrigerating compartment R. The evaporator 7 may be placed along one side, preferably, a rear surface, inside the freezing compartment F.

An ice maker 81 and a dispenser 82 serving ice of the ice maker 81 to a user may be provided in the door.

To connect the evaporator 7 to the ice maker 81 so that cool air of the evaporator is supplied to the ice maker 81, a first ice-making cool air passage 100 and a second ice-making cool air passage 200 are provided. In the first ice-making cool air passage 100, the cool air flowing from the evaporator to the ice maker may flow. The cool air discharged from the ice maker to return to the evaporator may flow in the second ice-making cool air passage 200.

Door-side cool air passages (see reference numerals 105 and 205 in FIG. 15) are provided in the door 3. The door-side cool air passage may operate together with the first and second ice-making cool air passages 100 and 200 to perform a cool air inflow and a cool air outflow through which the ice maker is connected.

The first ice-making cool air passage 100 and the second ice-making cool air passage 200 pass through the mullion. In other words, the ice-making cool air passages 100 and 200 may not be inserted into the inside of the vacuum adiabatic body, that is, the inside of the vacuum space serving as an adiabatic space. Accordingly, it is possible to prevent an adiabatic loss of the vacuum adiabatic body itself from occurring.

The ice-making cool air passage passing through the mullion may pass through the inside of the side panel 800. The side panel 800 may perform a function of guiding a shelf in the refrigerator or fixing a component and may be provided on a side surface of the refrigerator. The side panel 800 may be provided as a plate-shaped cover, or an inner space of the cover may be provided as an adiabatic space. The inside of the adiabatic space may be thermally insulated by a foam portion or the like. The side panel may be referred to as any of the cover, all of the cover and the adiabatic space, and both the cover, the adiabatic space, and the foam portion. The side panel 800 may be referred to as the cover.

The inner space of the side panel is covered from the space in the refrigerator so that a temperature atmosphere in the refrigerator and the ice-making cool air passages 100 and 200 are not affected with respect to each other.

The following operation may be obtained by the ice-making passage being covered by the side panel 800. First, it is possible to prevent the cool air of the first ice-making cool air passage 100 from being heat-exchanged with the inside of the refrigerating compartment to lose the cool air and deteriorate ice-making ability of the ice maker. The cool air of the ice-making cool air passage 100 may be continuously supplied to the refrigerating compartment to prevent stored items in the refrigerating compartment from being supercooled. Of course, an irreversible loss due to unnecessary heat exchange may be reduced.

Also, the supercooling of the stored items in the refrigerating compartment by the cool air of the second ice-making cool air passage 200 may be prevented to reduce the irreversible loss due to the unnecessary heat exchange.

Also, the first ice-making cool air passage 100 and the second ice-making cool air passage 200 may be spaced a predetermined distance from each other to prevent heat exchange from occurring between the ice-making cool air passages 100 and 200.

The first and second ice-making cool air passages 100 and 200 may be provided as passages connecting the evaporator to the ice maker to provide the shortest distance, thereby reducing the adiabatic loss. For this, the first and second ice-making cool air passages 100 and 200 have an inclined section having a certain angle that is different from vertical and horizontal states.

FIG. 9 is a schematic cross-sectional view of the freezing compartment-side ice-making cool air passage in the refrigerator according to an embodiment, and FIG. 10 is a schematic cross-sectional view of the refrigerating compartment-side ice-making cool air passage in the refrigerator according to an embodiment.

Referring to FIG. 9, the evaporator 7, a blower fan 150, and the first ice-making cool air passage 100 are disclosed. The evaporator 7 is placed along a rear side inside the freezing compartment to generate cool air. The blower fan 150 is placed at one side adjacent to the evaporator 7 to blow the cool air generated in the evaporator to an inlet-side of the first ice-making cool air passage 100.

The second ice-making cool air passage 200 may be disposed in front of the first ice-making cool air passage 100. In other words, when based on the evaporator 7, a discharge end of the second ice-making cool air passage 200 may be disposed farther than an inlet end of the first ice-making cool air passage 100. As a result, it is possible to prevent backflow of the blown cool air or a loss of a blowing pressure.

The first and second ice-making cool air passages 100 and 200 may not be disposed in or not pass through the vacuum space of the vacuum adiabatic body that is an adiabatic space at the freezing compartment-side. The first and second ice-making cool air passages 100 and 200 may be disposed in the inner space of the freezing compartment F in which a freezing atmosphere is formed.

The first and second ice-making cool air passages 100 and 200 may be narrow and have a wide channel cross-section in one direction. The wide surface of the channel may be disposed facing the inner surface of the freezing compartment. Accordingly, the larger space inside the freezing compartment may be obtained.

The blower fan 150 may directly suction the cool air of the evaporator 7, and for this purpose, the blower fan 150 may be disposed at a position adjacent to the evaporator 7. The blower fan 150 may be controlled together with other blowing proposes within the refrigerator, for example, an air circulation within the refrigerator. However, in consideration of the narrow channel of the ice-making cool air passage, the blower fan 150 may be separately provided for only the purpose of blowing the air to the inlet-side of the first ice-making cool air passage 100. The discharge end of the blower fan 150 may be sealed with the inlet end of the first ice-making cool air passage 100. Thus, the cool air may be blown at a high pressure in consideration of a pipeline loss.

The first and second ice-cooling passages 100 and 200 may not be thermally insulated by a separate adiabatic structure in the freezing compartment. Of course, if a difference in temperature atmosphere between the cool air inside the ice-making cool air passages 100 and 200 and the freezing compartment is large according to the passage structure of the cool air, a separate adiabatic structure for the ice-making cool air passage is not excluded.

Referring to FIG. 10, the first and second ice-making cool air passages 100 and 200 may move along the side surface of the refrigerating compartment R, and a wide surface of the channel may be disposed on the side surface of the refrigerating compartment. Thus, the description in the freezing compartment F may be applied as well. Differences with respect to the descriptions in the freezing compartment will be described.

The first and second ice-making cool air passages 100 and 200 may be disposed in the inner space of the side panel 800. The side panel is a portion for selecting a fixed position of the shelf or the like disposed in the refrigerator and allowing an operation of the shelf or the like. A rail 810 may be installed on the side panel to allow a slide operation of the shelf or the like.

It may be seen that the first ice-making cool air passage 100 extends by a certain distance toward the door-side. The first ice-making cool air passage 100 may be provided to be inclined to face the door-side, and the second ice-making cool air passage 200 may be provided to be inclined relatively slightly when compared to the first ice-making cool air passage 100.

The first and second ice-making cool air passages 100 and 200 may contact the inner surface of the vacuum adiabatic body. Accordingly, an adiabatic effect using the vacuum adiabatic body having a high adiabatic effect may be obtained, and a wider space within the refrigerator may be obtained by allowing the side panel to have a thickness as thin as possible.

The first and second ice-making cool air passages 100 and 200 may not be disposed in or not pass through the vacuum space of the vacuum adiabatic body that is an adiabatic space at the refrigerating compartment-side. The first and second ice-making cool air passages 100 and 200 may be disposed in the inn space of the refrigerating compartment R in which a refrigerating atmosphere is formed.

Hereinafter, a portion at which the first and second ice-making cool air passages 100 and 200 are connected to the door-side cool air passages 105 and 205 will be described.

The connection ends of the first and second ice-making cool air passages 100 and 200 and the connection ends of the first and second door-side cool air passages 105 and 205 may contact each other to the ice-making cool air to be introduced and discharged when the door is closed and may be spaced apart from each other so as not to supply the ice-making cool air when the door is opened.

FIG. 11 is a front perspective view illustrating the connection end between first and second ice-making cool air passage in the refrigerator, and FIG. 12 is a rear perspective view illustrating the connection end between first and second door-side ice-making cool air passage in the refrigerator.

Referring to FIG. 11, a first docking portion 104 and a second docking portion 204 may be disposed vertically on an inner side surface of the front portion of the side panel 800.

The first docking portion 104 may be an outlet end of the first ice-making cool air passage 100, and the second docking portion 204 may be an inlet end of the second ice-making cool air passage 100. The first docking portion 104 may be disposed to be spaced apart from the second docking portion 204 above the second docking portion 204.

A channel having a narrow and wide rectangular cross-section in one direction of each of the ice-making cool air passages 100 and 200 may be erected vertically. The two channels of the ice-making cool air passages 100 and 200 may be arranged in series with each other.

The vertical position relationship of the docking portions 104 and 204 will be described. The inlet end of the first ice-making cool air passage 100 may be disposed behind the inlet end of the second ice-making cool air passage 200. This is because the ice-making cool air passage is inclined upward toward a front side thereof.

To reverse the vertical relationship between the docking portions 104 and 204, the passage has to be twisted or bent while the two ice-making cool air passages extends, which may lead to the space loss in the refrigerator. The docking portions 104 and 204 may be configured as shown in order to provide natural circulation of the cool air discharged after the heavy cool air is supplied to the upper portion of the ice maker and then discharged to the lower side of the ice maker.

The first and second docking portions 104 and 204 may be disposed on the inner surface of the front end of the side panel 800. The inner surface of the front end may be provided to be inclined to be wider toward the outside of the main body. Thus, during the opening and closing operation of the door, the connection ends of the first and second ice-making cool air passages 100 and 200 and the connection ends of the first and second door-side cool air passages 105 and 205 may not interfere with each other and thus be smoothly opened and sealed.

Referring to FIG. 12, openings 811 and 812 may be defined in a side surface of the door 3 corresponding to the docking portions 104 and 204. Like the docking portions 104 and 204, the positional relationship of the openings may be provided to be inclined and may be arranged in series vertically.

The docking portion and the opening may be in contact with each other to provide a passage for the cool air, and a soft sealing material is interposed at both contact surfaces to prevent the cool air from leaking.

FIG. 13 is a view for explaining a relationship between the ice-making cool air passage and the mullion.

Referring to FIG. 13, the mullion 300 may be provided as a portion in which a foam portion is foamed inside a case so that the case and the foam portion are combined with each other. The mullion may partition the inner space. The first and second ice-making cool air passages 100 and 200 may pass through the mullion 300 and be supported by the mullion 300.

In the first ice-making cool air passage 100, a portion 101 within the first freezing compartment, in which the inlet end is disposed in the space of the freezing compartment, a first mullion portion 102 which passes through the mullion and of which at least a portion is disposed in the mullion, and a portion 103 within the first side panel, which is disposed on the side panel 800. The outlet end of the first ice-making cool air passage 100 may be disposed on the inside and the surface of the side panel or may protrude to the outside of the side panel.

Likewise, in the second ice-making cool air passage 200, a portion 201 within the second freezing compartment, in which the outlet end is disposed, a second mullion portion 202 which passes through the mullion and of which at least a portion is disposed in the mullion, and a portion 203 within the second side panel, which is disposed on the side panel 800. The inlet end of the second ice-making cool air passage 200 may be disposed on the inside and the surface of the side panel or may protrude to the outside of the side panel.

Since the first ice-making cool air passage 100 is installed in the refrigerator, a narrow and wide channel is installed close to the inner surface of the vacuum adiabatic body. This is the same also in the case of the second ice-making cool air passage 200. Thus, to ensure a smooth flow in the passage, the ice-making cool air passages 100 and 200 are bent toward the door-side at the connection portion with the door. An end of the ice-making cool air passage bent in the door direction may provide the docking portions 104 and 204. When the ice-making cool air passages 100 and 200 may be not only bent in front-rear and upward-downward directions but also bent in the lateral direction of the docking portions 104 and 204 with respect to the front of the refrigerator to guide the smooth flow of the air.

FIG. 14 is a view for explaining a structure on which the mullion is seated.

Referring to FIG. 14, the mullion 300 may be fixed to the inside of the vacuum adiabatic body. As an example for fixing the mullion 300 to the inside of the vacuum adiabatic body, the mullion seating frame 130 may be provided. The mullion 300 may be configured so that the mullion adiabatic material 320 is provided inside the mullion panel 321, and as a whole, a smooth adiabatic operation of the refrigerating and freezing spaces by the mullion 300 may be achieved.

The mullion seating frame 130 may have a vacuum adiabatic body extension extending along the inner surface of the vacuum adiabatic body and a mullion extension extending toward the mullion 300. The vacuum adiabatic body extension may be a portion extending vertically in the drawing, and the mullion extension may be a portion extending horizontally in the drawing.

As a preferable example, a frame having a cross-sectional structure that is bent once may be at least partially coupled to the mullion seating frame 130 along both sides and the rear surface of the inner surface of the vacuum adiabatic body.

FIG. 15 is a side perspective view for explaining an installation of the ice-making cool air passage and an adiabatic structure in the refrigerator.

Referring to FIG. 15, the mullion 300 may be disposed on the mullion seating frame 130, and the ice-making cool air passages 100 and 200 that passes through a portion of the mullion may be disposed inside the side panel 800. An adiabatic material is disposed inside the side panel 800 to allow the ice-making cool air passages 100 and 200 to be thermally insulated with respect to a relatively high temperature atmosphere in the refrigerating space.

A structure and a coupling method in which the ice-making cool air passages 100 and 200 are coupled to the mullion 300 and the side panel 800 will be described. As described above, a side panel adiabatic material 820 may be provided inside the side panel 800 to allow the inside of the side panel to be thermally insulated with respect to the inner space of the refrigerator. The mullion 300 may be provided with a mullion adiabatic material 320 inside the mullion panel 321 to thermally insulate and partition the space. The mullion adiabatic material 320 and the side panel adiabatic material 820 may preferably exemplify a foam adiabatic material.

The coupling method of the ice-making cool air passages 100 and 200, the mullion 300, the side panel 800, the mullion adiabatic material 320, and the side panel adiabatic material 820 will be described in detail. The portions may contribute to increase in adiabatic efficiency by allowing a distance between the portions to decrease as short as possible.

First, the ice-making cool air passages 100 and 200 may be disposed in the refrigerator in a state of being coupled to the side panel adiabatic material 820 and then be coupled to the inner surface of the vacuum adiabatic body. Here, the location in the refrigerator may mean that it is disposed at a fixed position in the refrigerator according to the design to prepare or wait for the following coupling process.

As a more specific example, first, the ice-making cool air passages 100 and 200 are coupled to the mullion panel 321 and the side panel 800. Thereafter, the side panel adiabatic material 820 may be foamed inside the side panel 800 so that all the portions are coupled to each other using the foaming material. Thereafter, it may be fixed to the inner surface of the vacuum adiabatic body.

As another example, after the ice-making cool air passages 100 and 200 are assembled on the inner surface of the vacuum adiabatic body, the mullion panel 321 and the side panel 800 may be coupled to each other. Thereafter, the side panel adiabatic material 820 may be foamed so that the mullion panel 321 and the side panel 800 are coupled to each other to form one body.

For another example, the side panel adiabatic material 820 may be foamed and integrated using a separate mold outside the ice-making cool air passages 100 and 200. Thereafter, an assembly of the ice-making cool air passages 100 and 200 and the side panel adiabatic material 820 may be coupled to the mullion panel 321 and the side panel 800. After that, it may be fixed to the inner surface of the vacuum adiabatic body.

In all of the above examples, the foaming process of the mullion adiabatic material 320 may be performed together with the foaming process of the side panel adiabatic material 820, and the coupling operation by the foaming portion may also be performed.

On the other hand, as another method, the ice-making cool air passages 100 and 200 may be disposed while the mullion adiabatic material 320 is foamed, and the assembly of the side panel 800 and the mullion panel 321 may be coupled to each other. Thereafter, the side panel adiabatic material 820 may be foamed to couple both the portions to each other. After all the coupling is completed, it may be coupled to the inner surface of the vacuum adiabatic body.

When the ice-making cool air passages 100 and 200 are fixed to the mullion panel 321 and the side panel 800, the ice-making cool air passages 100 and 200 may be disposed to pass through the mullion panel 321 and the side panel 800. In this case, each panel may become a foam cover so that a foam portion is filled in the foam cover by the foaming operation. All the portions may be coupled by the foam portion. In the coupled state, it may be seated on the inner surface of the vacuum adiabatic body.

The portions of fixing the ice-making cool air passages 100 and 200 may correspond to the mullion panel 321, the side panel 800, the mullion adiabatic material 320, and the side panel adiabatic material 820. In some cases, it may be one or two or more portions selected from the four portions.

The mullion panel 321 and the side panel 800 may be provided as one body, and thus, the single structure that is provided as one body may be provided as the foam covers that are conveniently used in the foaming process.

To prevent the ice-making cool air passages 100 and 200 from interfering with the mullion seating frame 130, a portion of the ice-making cool air passages 100 and 200 may be bent at an angle α. The angle α is for the purpose of allowing the ice-making cool air passage to pass over the mullion extension of the mullion seating frame. In another case, a cutoff portion may be provided in the mullion seating frame 130 to cut a portion through which each of the ice-making cool air passages 100 and 200 pass.

Hereinafter, an ice-making cool air passage according to another embodiment will be described.

This embodiment differs from the ice-making cool air passage according to the foregoing embodiment in that many portions of the ice-making cool air passage are accommodated in the mullion.

In other words, in the foregoing embodiment, although the ice-making cool air passage passes through the mullion, many portions are disposed inside the side panel. On the other hand, in this embodiment, the ice-making cool air passage is different in that being guided to a door-side, that is, to a front side through the mullion.

Accordingly, the ice-making cool air passage according to the forgoing embodiment may be referred to as a side panel-side ice-making cool air passage, and the ice-making cool air passage according to this embodiment may be referred to as a mullion-side ice-making cool air passage. However, to avoid the complexity of the excessive terms, the portions that may be understood in each portion of the text will be referred to as an ice-making cool air passage and then explained. However, in the portion at which special classification is necessary, different names are given and explained.

In the description of the following embodiment, the portions to which the content of the foregoing embodiment may be applied as it is will be applied to the description of the foregoing embodiment. In the case in which the same operation is performed, the same reference numeral will be given.

FIG. 16 is a schematic perspective view of an ice-making cool air passage in a refrigerator according to another embodiment. FIG. 17 is a view illustrating a relationship between a mullion and a door according to another embodiment.

Referring to FIGS. 16 and 17, a blower fan 150 transfers cool air generated in an evaporator to an inlet-side of a first ice-making cool air passage 100. The first ice-making cool air passage 100 extends along the mullions within the mullions. In this embodiment, a second ice-making cool air passage 200 may not move along the mullion, but may be guided directly to a freezing compartment from a lower end of a door. Thus, it is possible to prevent unnecessary waste of an inner adiabatic space of the mullion.

The second ice-making cool air passage 200 may be disposed at one side of the first ice-making cool air passage 100. Specifically, a discharge end of the second ice-making cool air passage 200 and an inlet end of the first ice-making cool air passage 100 may be disposed at left and right sides of a front end of the mullion.

The first and second ice-making cool air passages 100 and 200 may not be disposed on, may pass through, or may not pass through a vacuum space of the vacuum adiabatic body, which is an adiabatic space at a freezing compartment-side. The first and second ice-making cool air passages 100 and 200 may be disposed in an inner space of a freezing compartment F in which a freezing atmosphere is formed.

The first ice-making cool air passage 100 may have a narrow and wide flat channel cross-section, and the wide surface of the channel may be disposed along a plane of the mullion of the freezing compartment. Accordingly, a thickness of the mullion may be less or greater than that of the space within the refrigerator.

The first ice-making cool air passage 100 extends forward from the inside of the mullion. The first ice-making cool air passage 100 may have an extension 133 disposed inside the mullion 300 and extending forward and backward from the mullion in a state of being laid flatly, a downward inclined portion 132 that is inclined downward toward an evaporator 7 from a rear portion of the extension 133, a portion 131 within the freezing compartment, which extends to the inside of the freezing compartment, and an upward inclined portion that is inclined upward toward a door from the front portion of the extension 133.

The inclined portions 132 and 134 are configured to reduce a flow loss due to the narrow inner space of the channel by gently providing the passage. In the drawing, each of the inclined portions is indicated to be inclined at an angle α.

The portion 131 within the freezing compartment may be provided to improve ice-making performance of the ice maker by suctioning evaporator discharge air at a low temperature as much as possible.

An outlet of the upward inclined portion 134 may be provided at a portion that is aligned with a bottom surface of the door at a top surface of a front end of the mullion. A cool air passage extending from the ice maker may be connected to the bottom surface of the door.

The second ice-making cool air passage 200 may be disposed in a state of being aligned in a left and right direction with the outlet of the first ice-making cool air passage 100. All of the ice-making cool air passages 100 and 200 may be provided with narrow channels that are long in the left and right direction. This is done for allowing the ice-making cool air passages 100 and 200 to be in maximally insulated state in consideration of the narrow front and rear width of the door. The second ice-making cool air passage 200 may be provided as a structure that is similar to the upward inclined portion 134.

The door-side cool air passages 105 and 205 are the same as in the foregoing embodiment except that an end of the passage connected to the ice maker is led out from a lower end surface of the door, and the end is aligned in the left and right direction rather than a vertical direction.

In the inside of the mullion 300, the ice-making cool air passages 100 and 200 may be placed as close as possible to the freezing compartment F to prevent a cool air loss from occurring.

The inlet and outlet ends of the ice-making cool air passage may be exposed to the outside when the door is opened. Also, since an opened structure connected to the freezing compartment is provided, a switching structure may be provided.

FIGS. 18 and 19 are views for explaining the switching structure of the ice-making cool air passage, wherein FIG. 18 is a view illustrating a mullion side, and FIG. 19 is a view illustrating a door side.

Referring to FIG. 18, a switching door structure may be provided at an end of the ice-making cool air passage. In the switching door structure, a passage door 135 capable of opening and closing an opening of an upward inclined portion 134, a spring 136 guiding a rotation operation of the passage door, and a stopper 137 stopping the rotation of the door that rotates by force of the spring 36.

Since an end of the upward inclined portion 134 is provided to be inclined, a portion of the upward inclined portion 134 contacts the door when the door is closed to automatically open the passage door 135. A portion that is hung on the door when the door is opened may be released to allow the passage door 135 to be automatically closed. When the passage door 135 is closed, a limit by which the door is hung on the stopper 137 may be set.

Referring to FIG. 19, a pusher 1351 may be provided at a portion that is adjacent to outlet-side opening ends of the door-side cool air passages 105 and 205 on a bottom surface of the door. The pusher may push the passage door 135 to open the passage door.

The positional relationship between the pusher 1351 and the passage door 135 may be provided so that that when the door 3 is closed with respect to the main body 2, the pusher 1351 and the passage door 135 are disposed at positions at which the pusher 1351 and the passage door 135 are aligned with each other. A shape of each of the pusher 1351 and the passage door 135 may not be sharp to prevent the damage from occurring Of course, in addition to the non-sharped shape, it may have a variety of shapes and materials.

According to the switching door structure, the opening/closing of the door 3 with respect to the main body 2 and the opening/closing of the ice-making cool air passage may be performed in reverse. That is, when the door is closed, the ice-making cool air passage is opened, and when the door is opened, the ice-making cool air passage may be closed. According to this configuration, it is possible to improve the thermal performance by blocking leakage of the strong cool air used for ice-making. It may block foreign substances from being introduced.

The switching door structure may further be provided with structures that are opposite to each other. In other words, the passage door, the stopper, and the spring may be provided at the end of the door-side cool air passage, and the pusher may be provided at the end of the ice-making cool air passage. Accordingly, the cool air loss in the door-side cool air passage may be reduced.

In the switching door structure, a pair of switching structures may be provided at both the end of the ice-making cool air passage and the end of the door-side cool air passage, respectively. Accordingly, the door may be provided at both the end of the ice-making cool air passage and the end of the door-side cool air passage to prevent the cool air from leaking and to prevent the foreign substances from being introduced.

Hereinafter, the structure of the ice-making cool air passage in the case of the refrigerator according to the embodiment in which the vacuum adiabatic bodies are separated from each other will be described. For the portions without specific description, it is assumed that the contents of the foregoing embodiment are applied as it is. On the other hand, in the following contents, the door is not shown for convenience, but it is naturally understood that door is provided.

FIG. 20 is a perspective view of the refrigerator in which each vacuum adiabatic body provides each storage space. FIG. 21 is a perspective view of the refrigerator in a state in which a gap maintenance portion is provided at a connection portion between the vacuum adiabatic bodies.

In the refrigerator according to the embodiment, for example, a lower side may provide a refrigerating compartment as a storage space above the freezing compartment.

Referring to FIG. 20, a first body 2*a* and a second body 2*b* may be provided by independent vacuum adiabatic bodies. The bodies 2*a* and 2*b* may be spaced apart from each other. Components that are necessary for the operation of the refrigerator may be accommodated in a gap between the bodies 2*a* and 2*b* spaced apart from each other.

A gap maintenance portion 590 is provided in the gap between the vacuum adiabatic bodies so that the two upper and lower vacuum adiabatic bodies are firmly coupled to each other to form one body, thereby increasing in impact resistance. Components required for the operation of the refrigerator may be accommodated between the two vacuum adiabatic bodies provided by the gap maintenance portion 590.

In the evaporator provided in the second body 3*b*, contents required for the ice-making may be supplied to the first body 2*a*. For this, the first body 2*a* may be provided with a first ice-making connection passage 511 and a second ice-making connection passage 512 Although not shown, the ice-making connection passage having the same structure may extend from the second body 2*b*. The ice-making cool air passage may be inserted into the ice-making connection passage.

To supply the cool air from the evaporator to the ice maker using the ice-making cool air passage, the ice-making cool air passages 100 and 200 has to pass through a gap generated by the gap maintenance portion 590 and a wall of the vacuum adiabatic body. At least two vacuum adiabatic bodies may be connected to each other to pass through the gap between the two vacuum adiabatic bodies. However, it is not desirable for a heat loss through the gap and complexity of the structure.

As described above, the heat loss occurs along a supply path of the cool air, and particularly, the outside of the vacuum adiabatic body, i.g., the gap between the two vacuum adiabatic bodies provided by the gap maintenance portion 590, may act as an external space having room temperature. The room-temperature space may act as a major path for depriving the cool air required for ice-making, and thermal insulation in the path may create a limitation in supplying the cool air to the ice maker.

FIG. 22 is an enlarged view of the ice-making connection passage, and FIG. 23 is a cross-sectional view of the ice-making connection passage, taken along line A-A'.

Referring to FIGS. 22 and 23, it may be seen that the embodiment corresponds to a case in which the ice-making cool air is guided along the side surface of the refrigerator (see FIG. 8).

The ice-making connection passages 511 and 512 that connect the inner spaces of the bodies 2*a* and 2*b* are spaced apart from each other. A conductive resistance sheet 60 may be provided on a wall surface of each vacuum adiabatic body through which the ice-making connection passage passes to reduce thermal conductivity.

An ice-making passage adiabatic material 513 may be provided on an outer surface of each of the ice-making connection passages 511 and 512. A porous material may be provided as the ice-making passage adiabatic material 513 for thermal insulation. The ice-making passage adiabatic material 513 may also perform a role of supporting an impact absorbing function of the vacuum adiabatic body, a role of supporting a load of the first body 2*a*, and preventing damage of the gap maintenance portion 590.

FIGS. 24 to 27 are views of a refrigerator in which the freezing compartment and the freezing compartment are respectively provided by two vacuum adiabatic bodies, wherein the ice-making cool air passage is provided in the bottom surface of the door according to an embodiment. The description related to FIGS. 20 to 23 may be applied as it is without any specific explanation.

Referring to FIGS. 24 and 25, the two main bodies 2*a* and 2*b* are coupled to each other by the gap maintenance portion 590, and a pair of left and right ice-making connection passages 521 and 522 are provided on front portions of the main bodies 2*a* and 2*b*.

Referring to FIGS. 26 and 27, the ice-making connection passages 521 and 522 may pass through the ice-making cool air passages 100 and 200, and the conductive resistance sheet may be provided on the exposed wall surface of each vacuum adiabatic body provided with the ice-making connection passage to reduce a conductive heat loss. The ice-making passage adiabatic material 513 may perform the impact absorbing function of the vacuum adiabatic body, support the load of the first body, and prevent the damage of the body.

In the refrigerator according to this embodiment, a portion corresponding to the mullion in which the ice-making cool air passage is accommodated is not provided. In other words, the inner space of the portion at which the gap maintenance portion 590 is disposed may have room temperature and may not be suitable for allowing very cool air of the ice maker to pass. Reflecting this reason, it is more preferable not to locate an ice-making cool air passage in the gap between the gap maintenance portions 590.

However, it is not excluded from the aspect of the right of the present patent in which the ice-making cool air passage is disposed on the position at which the gap maintenance portion 590 is disposed. It may also be possible that the ice-making cool air passage is disposed in the gap maintenance portion if a sufficient adiabatic operation is performed. Nevertheless, deterioration in energy efficiency due to the adiabatic loss may occur. On the other hand, in this case, in each of the main bodies 2*a* and 2*b*, portions cut to allow the ice-making cool air passage to pass may be different from each other.

Hereinafter, an effect of the ice-making cool air passage according to an embodiment while reviewing a structure of the door that performs the ice making by using the cool air supplied using the ice-making cool air passage having various structures will be described.

A passage, in which the ice-making cool air passage is embedded in the foam portion that is the adiabatic space, is referred to as a foam-embedded ice-making cool air passage, a passage embedded in the side panel that is the inner space within the refrigerator, which is illustrated in FIG. 8, is referred to as a panel-side ice-making cool air passage, and a passage embedded in the mullion that is the inner space within the refrigerator, which is illustrated in FIG. 16, is referred to as a mullion-side ice-making cool air passage.

First, the case of the foam-embedded ice-making cool air passage will be described.

FIG. 28 is an exploded perspective of the door, and FIG. 29 is a horizontal cross-sectional view of a space in which an ice maker is installed. Referring to FIGS. 28 and 29, it is seen that a foam-embedded ice-making cool air passage is provided, an ice maker is provided in the door of the refrigerating compartment, and a rectangular adiabatic panel is installed outside the ice maker.

In an adiabatic structure of the door, the foam adiabatic material 606 is interposed in a gap between an outer case 603 and an inner cover 602 as a whole to improve the adiabatic performance of the door. The ice maker 81 and a basket 604 may be provided in the inner cover 602.

The ice-making cool air passage may be led in and out along the side surface of the door to extend vertically from the side surface of the door. An adiabatic panel 601 may be inserted into the gap between the foam adiabatic material 606 and the outer case 603 so as to be contributed to the improvement of the adiabatic performance of the door. The outer case 603 may have a shape of which both ends are bent inward, and an opening for a dispenser 82 may be provided in a lower portion of the outer case 603.

Second, a case of the side panel ice-making cool air passage will be described.

FIG. 30 is an exploded perspective view of a door, FIG. 31 is a horizontal cross-sectional view of the space in which the ice maker is installed, and FIG. 32 is a perspective view of a first vacuum adiabatic module.

Referring to FIGS. 30 to 32, in this embodiment, the side panel ice-making cool air passage may be provided, and the ice maker may be provided in the door of the refrigerating compartment. It is seen that a first vacuum adiabatic module is installed as a three-dimensional vacuum adiabatic module outside the ice maker. A partial technique of various vacuum adiabatic bodies illustrated in FIGS. 1 to 4 may be applied to the first vacuum adiabatic module. However, the first vacuum adiabatic module may be provided in a three-dimensionally curved shape.

The three-dimensional vacuum adiabatic module may prevent heat transfer in one direction, as well as prevent heat transfer in multi directions by using the vacuum space. The first vacuum adiabatic module 610 may prevent the heat transfer in the left and right direction as well as in the front direction with respect to the refrigerator door.

The first vacuum adiabatic module 610 may be provided with an upper opening 616 at an upper portion thereof. The upper opening may be opened so that water is introduced toward the door, and a wire passes therethrough. A lower opening 615 may be provided in a lower portion of the first vacuum adiabatic module 610. The lower opening 615 may be opened to provide a dispensing function for water or ice and lead in/out from the wire toward the door.

In the adiabatic structure of the door, the first vacuum adiabatic module 610 may be installed using the front surface and the side surface of the door. The first vacuum adiabatic module 610 may be thermally insulated by wrapping the front surface and the side surface of the door in a predetermined shape. A foam adiabatic material 606 may be provided outside the side surface of the first vacuum adiabatic module. The inner cover 602, the ice maker 81, the basket 604, and the door-side cool air passage 105, 205 may be disposed inside the first vacuum adiabatic module 610. This embodiment is different from the first case in that lateral heat conduction is not blocked.

The ice-making cool air passage may be led in and out along the side surface of the door to extend vertically from the side surface of the door. The outer case 603 may have a shape of which both ends are bent inward, and an opening for a dispenser 82 may be provided in a lower portion of the outer case 603.

Third, the case of the mullion-side ice-making cool air passage will be described.

FIG. 33 is an exploded perspective view of the door, and FIG. 34 is a perspective view of a first vacuum adiabatic module. A cross-sectional view of the door is the same as that in FIG. 31.

In the case of the mullion-side ice-making cool air passage, as illustrated in FIG. 16, the ice-making cool air passage is provided inside the mullion. Also, when compared to the second case, in the door, it is characteristically different that the three-dimensional vacuum adiabatic module is changed to the second vacuum adiabatic module 620.

Specifically, in the outer case 603, a portion on which the dispenser 82 is disposed is referred to as a lower portion L, and an upper portion thereof is referred to as an upper portion U. Here, in the case of the side panel side ice-making cool air passage, only the upper portion may be thermally insulated, and the mullion-side ice-making cool air passage may thermally insulate both the upper portion and the lower portion.

The second vacuum adiabatic module 620 further includes a window dispenser 621 of which a front surface is opened in the form of a window in addition to the upper and lower openings 615 and 616. The window dispenser may allow a user to approach an ice dispenser structure. The conductive resistance sheet may be additionally provided at an edge of the window dispenser 621 to reduce heat conduction between the inner and outer plates.

The results of the experiment will be described for the above-described three cases.

FIGS. 35 to 37 are views illustrating thermal efficiency of the ice-making cool air passage in the above-described three cases. FIGS. 35 to 37 are views illustrating a case in which the foam-embedded ice-making cool air passage and the adiabatic panel are installed, FIG. 36 is a view illustrating a case in which the side panel ice-making cool air passage and the first vacuum adiabatic module are installed, and FIG. 37 is a view illustrating a case in which the mullion ice-making cool air passage and the second vacuum adiabatic module are installed.

Each experiment are performed under inflow air having a temperature of about 20 degrees Celsius below zero, a flow rate of about 0.2CMM, external air having a temperature of about 20 degrees Celsius, a refrigerating compartment temperature of about 3.6 degrees Celsius, and a freezing compartment temperature of about 18 degrees Celsius.

Referring to FIGS. 35 to 37, it is seen that the temperature rise of the cool air at each point appears as a numerical value. Since the temperature rise in the third case is the smallest, it may be considered as having the best adiabatic effect.

Table 1 is a table of the results of experiments with respect to the cool air loss. Here, a heat penetration amount is expressed by a unit of watts (W), and a pressure loss is expressed by a unit of MPa.

TABLE 1

| | Heat penetration amount (1) | Pressure loss (1) | Heat penetration amount (2) | Pressure loss (2) | Heat penetration amount (3) | Pressure loss (3) |
|---|---|---|---|---|---|---|
| Ice-making passage inlet | 4.55 | 21.9 | 3.42 | 18.6 | 1.46 | 14.5 |
| Door inflow duct | 1.74 | 17.9 | 1.75 | 21.3 | 2.42 | 27.9 |
| Ice-making room | 5.78 | 4.0 | 5.33 | 5.7 | 5.05 | 3.3 |
| Door discharge duct | 0.61 | 14.3 | 0.94 | 14.2 | 0.92 | 11.7 |
| Ice-making passage discharge | 2.12 | 14.5 | 1.86 | 15.0 | 0.14 | 3.7 |
| Total | 14.81 | 72.6 | 13.30 | 74.8 | 9.99 | 61.2 |

Referring to Table 1, when compared to the first case, in the second case, an ice-making amount increases by about 10%, and in the third case, an ice-making amount increases by about 20%.

INDUSTRIAL APPLICABILITY

The embodiment proposes the structure for guiding the cool air to the ice maker in the refrigerator door of the refrigerator by using the vacuum adiabatic body. The above-described structure may realizes the high energy consumption efficiency and may more widely secure the space in the refrigerator.

According to the embodiment, it may be possible to further access to the actual production of the refrigerator utilizing the high vacuum and obtain the advantage that may be used industrially.

The invention claimed is:

1. A refrigerator comprising:

a vacuum adiabatic body including:

a first plate configured to provide at least a portion of a wall defining a space within the refrigerator;

a second plate configured to provide at least a portion of an outer wall of the refrigerator;

a sheet configured to seal the first plate and the second plate so as to provide a vacuum space between the first plate and the second plate;

a partition configured to divide the space within the refrigerator into a refrigerating compartment and a freezing compartment;

an ice maker positioned away from the freezing compartment; and at least one air passage passing through the partition to fluidly connect the freezing compartment to the ice maker.

2. The refrigerator according to claim 1, wherein the air passage extends along the first plate.

3. The refrigerator according to claim 1, wherein the air passage extends along the partition.

4. The refrigerator according to claim 3, wherein a portion of the air passage is accommodated in the partition.

5. The refrigerator according to claim 1, wherein the air passage has a cross-section that extends further in a first direction than in a second direction.

6. A refrigerator comprising:

a vacuum adiabatic body including a freezing compartment and a refrigerating compartment;

a partition configured to separate the refrigerating compartment from the freezing compartment;

an evaporator positioned in the freezing compartment to generate cool air;

a door configured to open and close the refrigerating compartment;

an ice maker positioned in the door; and an air passage that is provided within the refrigerating compartment and passes through the partition to guide the cool air generated in the evaporator toward the ice maker.

7. The refrigerator according to claim 6, further comprising a side panel provided at a wall of the refrigerating compartment, wherein the air passage is accommodated in the side panel of the refrigerating compartment.

8. The refrigerator according to claim 7, wherein a side panel adiabatic material is configured to surround at least a portion of the air passage in the side panel.

9. The refrigerator according to claim 8, wherein the side panel adiabatic material is a foamed material.

10. The refrigerator according to claim 8, wherein the partition includes a partition panel and a partition adiabatic material provided in the partition panel.

11. The refrigerator according to claim 10, wherein the partition adiabatic material and the side panel adiabatic material are a foamed material.

12. The refrigerator according to claim 6, wherein the air passage is a first air passage; and wherein the refrigerator further comprises a second air passage configured to return air from the ice maker toward the evaporator.

13. The refrigerator according to claim 6, wherein the air passage is connected to a door-side air passage in the door and having an opening on a side surface of the door.

14. The refrigerator according to claim 6, wherein the air passage is connected to a door-side air passage in the door and having an opening on a bottom surface of the door.

15. The refrigerator according to claim 14, wherein a gate is provided at a connection of the air passage and the door-side air passage.

16. The refrigerator according to claim 6, wherein the vacuum adiabatic body includes:

a first plate configured to define at least a portion of a wall for the accommodation space;

a second plate configured to define at least a portion of an outer wall;

a sheet configured to seal the first plate and the second plate so as to provide a vacuum space between the first plate and the second plate; and a support configured to maintain the vacuum space.

17. The refrigerator according to claim 6, wherein the door includes a vacuum adiabatic module, and the vacuum adiabatic module is configured to form at least portion of a front surface and a side surface of the door.

18. The refrigerator according to claim 17, wherein the vacuum adiabatic module includes an opening for a dispenser provided on front surface of the door.

19. A refrigerator comprising:

a first body having a first opening to access a freezing space, the first body including a first vacuum adiabatic body having a first vacuum space;

a first door configured to open and close the first opening of the first body;

a second body having a second opening to access a refrigerating space, the second body including a second vacuum adiabatic body having a second vacuum space;

a second door configured to open and close the second opening of the second body;

an ice maker provided in the second door; and an air passage configured to pass through an adiabatic portion of a boundary between the first vacuum adiabatic body and the second vacuum adiabatic body so as to guide cool air of the freezing space toward the ice maker.

20. The refrigerator according to claim 19, wherein the first vacuum space of the first vacuum adiabatic body and the second vacuum space of the second vacuum adiabatic body communicate with each other.

* * * * *